US011087946B2

(12) United States Patent
Matsuura et al.

(10) Patent No.: US 11,087,946 B2
(45) Date of Patent: Aug. 10, 2021

(54) X-RAY TUBE

(71) Applicant: FUJIFILM Corporation, Tokyo (JP)

(72) Inventors: Masayoshi Matsuura, Ashigarakami-gun (JP); Takeyasu Kobayashi, Ashigarakami-gun (JP); Shunsuke Kodaira, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 46 days.

(21) Appl. No.: 16/369,988

(22) Filed: Mar. 29, 2019

(65) Prior Publication Data

US 2019/0304736 A1 Oct. 3, 2019

(30) Foreign Application Priority Data

Mar. 30, 2018 (JP) ..... JP2018-069529

(51) Int. Cl.
*H01J 35/16* (2006.01)

(52) U.S. Cl.
CPC ..... *H01J 35/16* (2013.01); *H01J 2235/166* (2013.01)

(58) Field of Classification Search
None
See application file for complete search history.

(56) References Cited

U.S. PATENT DOCUMENTS

2004/0066901 A1 4/2004 Artig et al.
2004/0202282 A1 10/2004 Miller
2013/0322602 A1 12/2013 Zhang et al.
2014/0226792 A1* 8/2014 Hansen ..... H01J 35/06 378/141
2018/0182592 A1 6/2018 Kato et al.

FOREIGN PATENT DOCUMENTS

| | | | |
|---|---|---|---|
| CN | 106783489 | A | 5/2017 |
| JP | 56-167464 | U | 4/1982 |
| JP | 58-96662 | U | 6/1983 |
| JP | 39-13934 | Y | 5/1984 |
| JP | 4-98254 | U | 8/1992 |

(Continued)

OTHER PUBLICATIONS

Office Action dated Dec. 8, 2020 in Japanese Patent Application No. 2018-069529. with Engiish translation.

(Continued)

*Primary Examiner* — Edwin C Gunberg
(74) *Attorney, Agent, or Firm* — Birch, Stewart, Kolasch & Birch, LLP

(57) ABSTRACT

An X-ray tube includes: a cathode assembly that emits electrons; an anode that receives the electrons and generates X-rays; an envelope that is a case having the cathode assembly and the anode accommodated therein; a first shielding portion that shields the X-rays between the envelope and the cathode assembly on a reference line that connects a center of a point where the electrons are generated and a center of a point where the X-rays are generated; and a second shielding portion that shields the X-rays between the envelope and the cathode assembly in a direction perpendicular to the reference line from the center of the electron generation point.

18 Claims, 24 Drawing Sheets

(56) References Cited

FOREIGN PATENT DOCUMENTS

| | | | |
|---|---|---|---|
| JP | 2001-273998 | A | 10/2001 |
| JP | 2006-523005 | A | 10/2006 |
| JP | 2017-37774 | A | 2/2017 |
| KR | 10-2008-0099028 | A | 11/2008 |

OTHER PUBLICATIONS

Office Action dated Dec. 8, 2020 in Japenese Patent Application No. 2019-068087, with English translation.
Japanese Office Action for corresponding Japanese Application No. 2018-069529, dated May 25, 2021, with English translation.

* cited by examiner

X-RAY TUBE

CROSS-REFERENCE TO RELATED APPLICATIONS

This application claims priority under 35 U.S.C § 119(a) to Japanese Patent Application No. 2018-069529 filed on 30 Mar. 2018. The above application is hereby expressly incorporated by reference, in its entirety, into the present application.

BACKGROUND OF THE INVENTION

1. Field of the Invention

The present invention relates to an X-ray tube.

2. Description of the Related Art

In general, in an X-ray tube, a cathode that emits electrons and an anode that receives the electrons emitted from the cathode and generates X-rays are provided in a vacuum tube such as a glass envelope. X-rays are generated from a position where electrons collide, that is, a position (so-called focus) where X-rays are generated in all directions. However, for example, in the capture of X-ray images, only X-rays generated in a predetermined direction are used and X-rays generated in the other directions are not used and become unnecessary X-rays. Therefore, in the X-ray tube according to the related art, the outside of the X-ray tube is covered with a housing made of an X-ray shielding material, such as lead, to shield unnecessary X-rays.

In addition, in an X-ray tube disclosed in JP2001-273998A (corresponding to US2004/066901A1), in order to shield unnecessary X-rays, a disk-shaped member for supporting a cathode is made of an X-ray shielding material to shield some of unnecessary X-rays in the X-ray tube. Similarly, in an X-ray tube disclosed in JP2006-523005A (corresponding to US2004/202282A1), an X-ray shielding disk is provided between a cathode and an anode to shield some of unnecessary X-rays in the X-ray tube.

SUMMARY OF THE INVENTION

An object of the invention is to provide an X-ray tube having a lighter weight than an X-ray tube in which a shielding member is provided only outside an envelope which is a case having a cathode assembly including at least a cathode and an anode accommodated therein.

According to the invention, there is provided an X-ray tube comprising: a cathode assembly that emits electrons; an anode having a target that receives the electrons and generates X-rays; an envelope that is a case having the cathode assembly and the anode accommodated therein; a first shielding portion that shields the X-rays between the envelope and the cathode assembly on a reference line that connects a center of a point where the electrons are generated and a center of a point where the X-rays are generated; and a second shielding portion that shields the X-rays between the envelope and the cathode assembly in a direction perpendicular to the reference line from the center of the electron generation point.

Preferably, the first shielding portion is longer than the cathode assembly in the direction perpendicular to the reference line.

Preferably, the second shielding portion is longer than the cathode assembly in a direction parallel to the reference line.

Preferably, the second shielding portion protrudes from the cathode assembly to the anode.

Preferably, some or all of angles formed between the first shielding portion and the second shielding portion are 90 degrees.

Preferably, some or all of angles formed between the first shielding portion and the second shielding portion are greater than 90 degrees and less than 180 degrees.

Preferably, some or all of angles formed between the first shielding portion and the second shielding portion are less than 90 degrees.

Preferably, angles formed between the first shielding portion and the second shielding portion include an angle of 90 degrees and an angle that is greater than 90 degrees and less than 180 degrees.

Preferably, angles formed between the first shielding portion and the second shielding portion include an angle of 90 degrees and an angle of less than 90 degrees.

Preferably, angles formed between the first shielding portion and the second shielding portion include an angle that is greater than 90 degrees and less than 180 degrees and an angle of less than 90 degrees.

Preferably, angles formed between the first shielding portion and the second shielding portion include an angle of 90 degrees, an angle that is greater than 90 degrees and less than 180 degrees, and an angle of less than 90 degrees.

Preferably, the X-ray tube further comprises an electrode that is electrically connected to the first shielding portion or the second shielding portion.

Preferably, the first shielding portion is bonded to the cathode assembly.

Preferably, the second shielding portion is bonded to the cathode assembly.

Preferably, an edge of the first shielding portion and/or the second shielding portion is rounded.

Preferably, the X-ray tube further comprises a tube wall shielding member that is provided on a portion of the envelope which the X-rays reach and shields the X-rays.

Preferably, the tube wall shielding member is provided in at least an intersection portion between the envelope and a plane extending from an anode surface which is a surface of the anode including the X-ray generation point.

Preferably, the second shielding portion is made of a material having easier workability than a material forming the first shielding portion.

According to the invention, it is possible to provide an X-ray tube having a lighter weight than an X-ray tube in which an X-ray shielding member is provided only outside an envelope which is a case having a cathode assembly including at least a cathode and an anode accommodated therein.

DESCRIPTION OF THE PREFERRED EMBODIMENTS

First Embodiment

Figure 1:
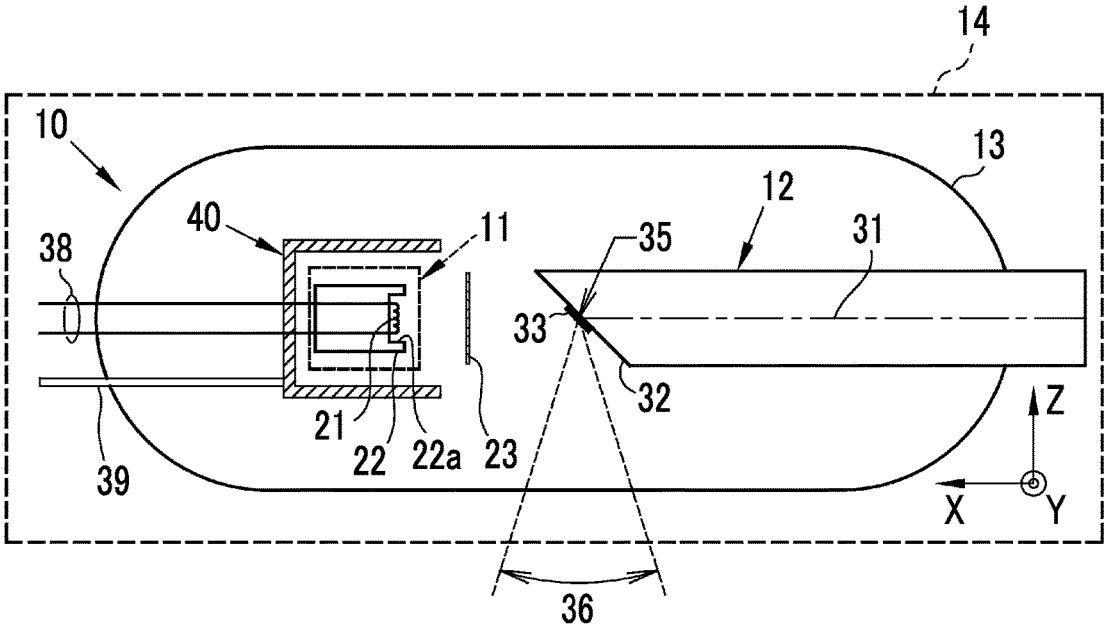
FIG. 1 is a cross-sectional view schematically illustrating an X-ray tube.

As illustrated in FIG. 1, an X-ray tube 10 comprises a cathode assembly 11 including a cathode, an anode 12, and an envelope 13. The X-ray tube 10 and a housing 14 form an X-ray tube device.

The cathode assembly 11 emits electrons. In this embodiment, the cathode assembly 11 emits electrons in a negative X direction. In this embodiment, a direction parallel to a central axis 31 of the anode 12 is referred to as the X direction, a direction that is perpendicular to the central axis 31 of the anode 12 and is in the plane of paper in the drawings is referred to as the Z direction, and a direction perpendicular to the X direction and the Z direction is referred to as the Y direction. In addition, a direction toward the left side of the plane of paper in the drawings is referred to as a positive X direction, a direction toward the upper side of the plane of paper in the drawings is referred to as a positive Z direction, and a front direction of the plane of paper in the drawings is referred to as a positive Y direction.

The cathode assembly 11 includes at least the cathode. For example, a hot cathode, such as a filament 21, or a cold cathode using carbon nanotube CNT can be used as the cathode. In this embodiment, the cathode assembly 11 includes, for example, the filament 21 and a first electrode 22. In addition, the cathode assembly 11 does not include a second electrode 23, a support member that supports wires for the second electrode 23 and the envelope 13, a support member that supports wires for the filament 21 and the envelope 13, and a support member that supports wires for the first electrode 22 and the envelope 13. However, if necessary, the cathode assembly 11 includes, for example, some or all of insulating members for insulating the filament 21, the first electrode 22, and the second electrode 23 or members for connecting these components to support or position these components.

In a case in which a current flows to the filament 21 and a tube voltage is applied to the filament 21, the filament 21 emits electrons (thermal electrons). The current flowing through the filament 21 is a filament current and the amount of electrons emitted from the filament 21 is a tube current of the X-ray tube 10. The filament 21 is made of, for example, tungsten.

The first electrode 22 is a so-called focusing cup. The first electrode 22 includes, for example, a concave portion 22*a* having a rectangular parallelepiped shape. The filament 21 is provided in the concave portion 22*a* of the first electrode 22. The first electrode 22 contributes to the convergence of the electrons. A predetermined voltage is applied to the first electrode 22. The predetermined voltage applied to the first electrode 22 is, for example, −50 kV or 0 V.

The second electrode 23 is a so-called grid electrode. The second electrode 23 is provided between the cathode assembly 11 and the anode 12. For example, a predetermined voltage of −5 kV is applied to the second electrode 23. For example, in a case in which other members are illustrated, the second electrode 23 may not be illustrated. Even in a case in which the second electrode 23 is not illustrated in the drawings, the X-ray tube 10 includes the second electrode 23. However, in some cases, in the actual X-ray tube 10, the second electrode 23 is not provided. That is, in the X-ray tube 10, the second electrode 23 is not essential. In addition, the emission direction of electrons is corrected by the electric field of the second electrode 23. However, the emission direction of electrons may be corrected by a member that generates a magnetic field, such as a coil, instead of the second electrode 23 or in addition to the second electrode 23.

The filament 21, the first electrode 22, and the second electrode 23 form an electron gun. That is, the flow (electron beam) of the electrons emitted from the filament 21 forms a cross-over having a smaller cross-sectional radius than that other portions at a predetermined position, using the lens action of the first electrode 22 and the second electrode 23. Then, the electrons reach a target 33 on the anode 12 which is a positively charged electrode in a state in which the diameter of the cross-over is reduced.

The anode 12 receives the electrons emitted from the cathode assembly 11 and generates X-rays. A predetermined voltage is applied between the anode 12 and the cathode assembly 11. The predetermined voltage applied between the anode 12 and the cathode assembly 11 is a tube voltage of the X-ray tube 10. The anode 12 has, for example, a shape obtained by obliquely cutting a cylinder with respect to the central axis 31. An oblique surface 32 obtained by the cutting faces the cathode assembly 11. The direction in which the "oblique surface 32 faces the cathode assembly 11" means a direction in which the electrons emitted from the cathode assembly 11 can collide with the oblique surface 32 of the anode 12. In this embodiment, the central axis 31 of the anode 12 is parallel to the X-axis. A distance between the cathode assembly 11 and the oblique surface 32 in the positive Z direction from the central axis 31 is relatively short and a distance between the cathode assembly 11 and a portion of the oblique surface 32 in the negative Z direction from the central axis 31 is relatively long.

The anode 12 comprises the target 33 at a position on the oblique surface 32 which the electrons emitted from the cathode assembly 11 collide. The target 33 is made of, for example, tungsten, receives the electrons emitted from the cathode assembly 11, and generates X-rays. Therefore, the oblique surface 32 is one surface of the anode 12 and includes an X-ray generation point 35 (the focus of the electron beam emitted from the cathode assembly 11). The X-ray generation point 35 is a portion which the electron beam hits, that is, the focus of the electron beam emitted from the cathode assembly 11. In a case in which the focus of the electron beam emitted from the cathode assembly 11 has a size (range) that is not negligible, the X-ray generation point 35 is the entire range. Hereinafter, the oblique surface 32 which is the "surface of the anode 12 including the X-ray generation point 35" is referred to as an anode surface 32. In addition, a "leading end" of the anode 12 is referred to as an end including the anode surface 32 and a "base end" of the anode 12 is referred to as an end outside the envelope 13. The anode 12 is made of, for example, a material with high thermal conductivity, such as copper. This material is used to exhaust or dissipate heat generated from the target 33 in a case in which X-rays are generated through the anode 12.

X-rays are generated from the generation point 35 in all directions. In the X-ray tube 10, for example, X-rays generated in a predetermined direction (hereinafter, referred to as a usage direction) 36 from the X-ray generation point 35 are used for X-ray imaging. Therefore, X-rays generated in directions other than the usage direction 36 are unnecessary X-rays that are not used for, for example, X-ray imaging. Unnecessary X-rays are shielded by an X-ray shielding member, such as lead, in order to avoid unnecessary exposure.

The envelope 13 is a case having the cathode assembly 11 and the anode 12 accommodated therein. The envelope 13 having the cathode assembly 11 "accommodated therein" means the envelope 13 having at least the filament 21 which is an electron generation point accommodated therein. In this embodiment, since the cathode assembly 11 includes the first electrode 22 in addition to the filament 21, the filament 21 and the first electrode 22 are present in the envelope 13. However, for example, wires 38 for making a current flow to the filament 21, wires (not illustrated) for applying a voltage to the first electrode 22, and wires (not illustrated) for applying a voltage to the second electrode 23 extend to the outside of the envelope 13. For example, each of the wires 38 also functions as a support member that supports the filament 21 with respect to the envelope 13. In addition, the envelope 13 having the anode 12 "accommodated therein" means the envelope 13 having at least the anode surface 32 of the anode 12 accommodated therein. In this embodiment, the anode 12 extends to the outside of the envelope 13.

The envelope 13 is, for example, a vacuum tube such as a glass tube. The inside of the envelope 13 is so vacuous that at least the electrons emitted from the cathode assembly 11 (filament 21) can reach the anode 12. The envelope 13 transmits X-rays at least in the range of the usage direction 36.

The housing 14 covers almost the entire envelope 13 to insulate the envelope 13, to cool the envelope 13 with a cooling medium, and/or to shield unnecessary X-rays. However, an X-ray transmission window (not illustrated) that transmits X-rays is provided in the range of the usage direction 36.

In addition, the X-ray tube 10 comprises a shielding portion 40 that is provided in the envelope 13. The shielding portion 40 includes, for example, an X-ray shielding member, such as lead, and shields unnecessary X-rays behind the cathode assembly 11 and on the side of the cathode assembly 11. The term "behind the cathode assembly 11" means a space between the cathode assembly 11 and a portion of the envelope 13 which is opposite to the anode 12. The side of the cathode assembly 11 means a space between the cathode assembly 11 and the envelope 13 in a direction perpendicular to a reference line 50 illustrated in FIG. 2. In addition, the term "in front of the cathode assembly 11" means a space between the cathode assembly 11 and the anode 12. In this embodiment, the shielding portion 40 has a cylindrical shape (cup shape) with a bottom. However, the outward shape of the shielding portion 40 may be other prismatic shapes. The shielding portion 40 supports the envelope 13 using a support portion 39. The support portion 39 extends to the outside of the envelope 13.

Figure 2:
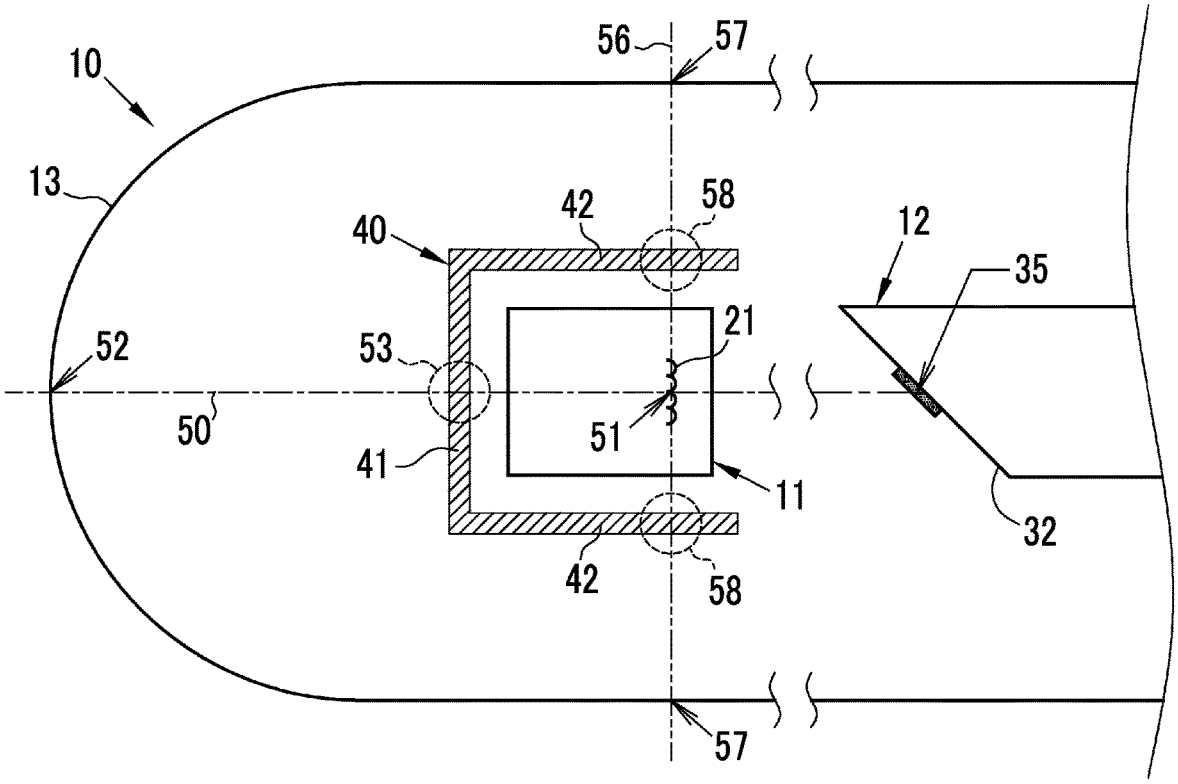
FIG. 2 is a cross-sectional view illustrating the configuration of a shielding portion.

As illustrated in FIG. 2, the shielding portion 40 comprises a first shielding portion 41 and a second shielding portion 42. That is, the X-ray tube 10 comprises the first shielding portion 41 and the second shielding portion 42 provided in the envelope 13.

The first shielding portion 41 shields unnecessary X-rays between the envelope 13 and the cathode assembly 11 on the reference line 50. That is, the first shielding portion 41 is a portion of shielding portion 40 which shields unnecessary X-rays behind the cathode assembly 11.

The reference line 50 is a straight line (half line) that has a center 51 of the electron generation point as a starting point and connects the center 51 of the electron generation point and the center of the X-ray generation point. In this embodiment, the reference line 50 is a center line that passes through the center of the cathode assembly 11. The electron generation point is a portion of the filament 21 which can emit thermal electrons in a case in which a current flows and a voltage is applied. For example, in a case in which the filament 21 is sufficiently small and is regarded as a point in the relationship with other members, the electron generation point is the entire filament 21. The center 51 of the electron generation point is substantially the center (a center in a case in which a three-dimensional size is considered) of the filament 21. In this embodiment, the center 51 of the electron generation point is the center of the filament 21. In a case in which the X-ray generation point 35 is sufficiently small, the center of the X-ray generation point 35 is the X-ray generation point 35. In a case in which the size (range) of the X-ray generation point 35 is not negligible, the center of the X-ray generation point 35 is the center (a center in a case in which a three-dimensional size is considered) of the X-ray generation point 35. In this embodiment, it is assumed that the size of the X-ray generation point 35 is sufficiently small to be negligible. Therefore, in this embodiment, the center of the X-ray generation point 35 is synonymous with the X-ray generation point 35.

The reference line 50 intersects the envelope at an intersection point 52. In addition, the reference line 50 intersects the first shielding portion 41 at an intersection point 53. That is, the first shielding portion 41 shields unnecessary X-rays at least outside the cathode assembly 11 (including the surface of the cathode assembly 11) as a whole and at a point (intersection point 53) on the reference line 50 between the cathode assembly 11 and the intersection point 52. For example, in a case in which a hole or a cutout is provided in a portion corresponding to the intersection point 53 for wiring or other purposes, the second shielding portion 42 is not provided in the portion corresponding to the intersection point 53. In this case, the "shielding of unnecessary X-rays at the intersection point 53" means that, in a case in which a hole or a cutout for, for example, wiring is used as the first shielding portion 41 filled with the X-ray shielding member, unnecessary X-rays can be shielded in the portion corresponding to the intersection point 53.

The second shielding portion 42 shields unnecessary X-rays between the envelope 13 and the cathode assembly 11 in a direction perpendicular to the reference line 50 from the center 51 of the electron generation point. That is, the second shielding portion 42 is a portion of the shielding portion 40 which shields unnecessary X-rays on the side of the cathode assembly 11. In a case in which a plane that passes through the center 51 of the electron generation point and is perpendicular to the reference line 50 is a reference plane 56, the reference plane 56 (a line in FIG. 2) intersects the envelope 13 on an intersection line 57 (a point in FIG. 2). In addition, in this embodiment, the reference plane 56 intersects the second shielding portion 42 on an intersection line 58 (a point in FIG. 2). That is, the second shielding portion 42 shields unnecessary X-rays at least outside the cathode assembly 11 as a whole and at a point (at least some of the points on the intersection line 57) between the center 51 of the electron generation point and the envelope 13. For example, in a case in which a hole or a cutout is provided in a portion corresponding to the intersection line 57 for wiring or other purposes, the second shielding portion 42 is not provided in the portion. In this case, the "shielding of unnecessary X-rays on the intersection line 58" means that, in a case in which, for example, a hole or a cutout is used as the second shielding portion 42 filled with the X-ray shielding member, unnecessary X-rays can be shielded in the portion corresponding to the intersection line 58.

Figure 3:
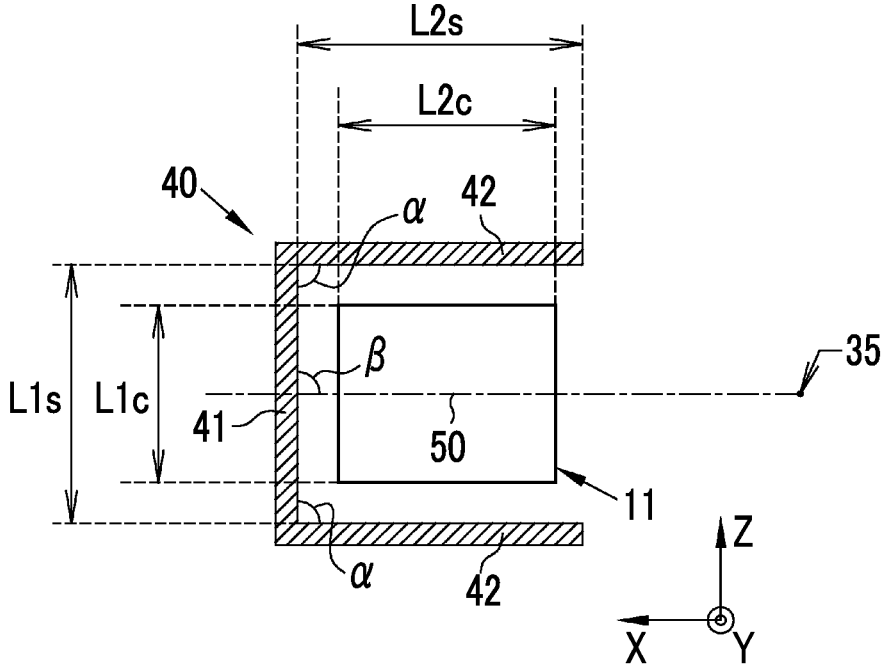
FIG. 3 is a diagram illustrating the relative sizes of a cathode assembly and a shielding portion.

As illustrated in FIG. 3, the first shielding portion 41 is longer than the cathode assembly 11 in the direction perpendicular to the reference line 50. In a case in which the length of the cathode assembly 11 in a direction (for example, the Z-axis direction) in the YZ plane is "L1*c*" and the length of the first shielding portion 41 in the direction in the YZ plane is "L1*s*", L1*c*<L1*s* is satisfied. In addition, the second shielding portion 42 is longer than the cathode assembly 11 in the direction parallel to the reference line 50. In a case in which the length of the cathode assembly 11 in a direction (for example, the X-axis direction) in the XY plane is "L2*c*" and the length of the second shielding portion 42 in the direction in the XY plane is "L2*s*", L2*c*<L2*s* is satisfied. In addition, in this embodiment, an angle α formed between the first shielding portion 41 and the second shielding portion 42 is 90 degrees and an angle β formed between the reference line 50 and the first shielding portion 41 is 90 degrees.

Figure 4:
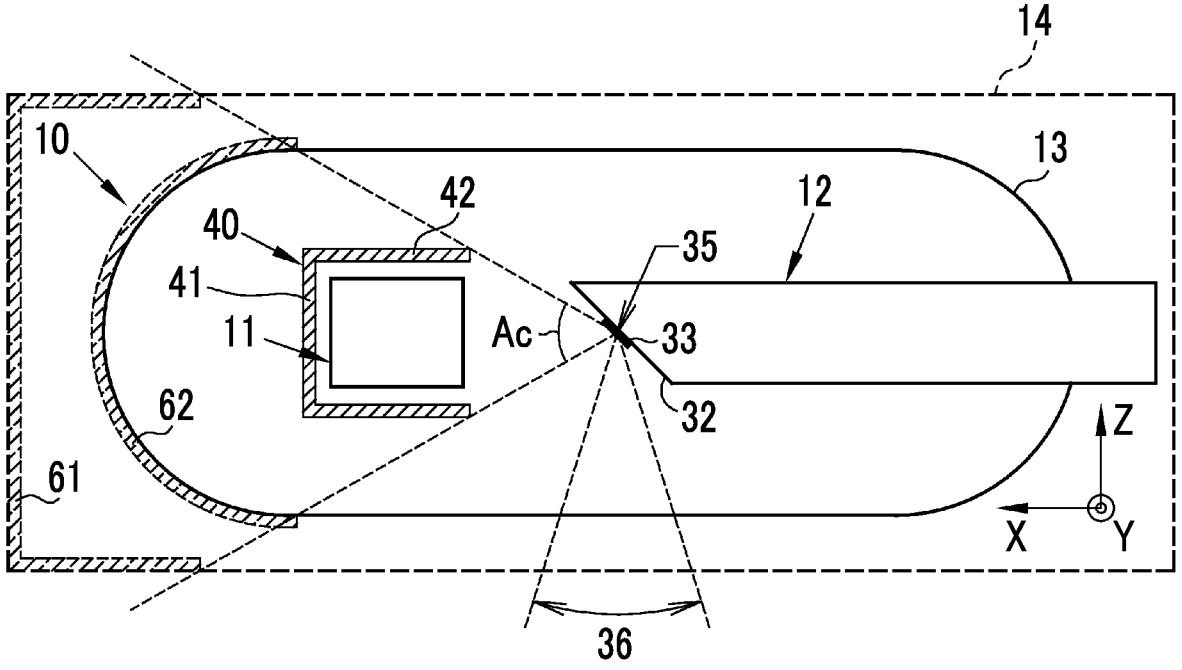
FIG. 4 is a diagram illustrating the operation of the shielding portion.

As described above, the X-ray tube 10 has the shielding portion 40 including the first shielding portion 41 and the second shielding portion 42. Therefore, in the X-ray tube 10, the usage (weight) of the X-ray shielding member can be less than that in a case in which the X-ray shielding member is provided only outside the envelope 13. As a result, it is possible to reduce the weight of the X-ray tube 10. For example, as illustrated in FIG. 4, the shielding portion 40 can shield unnecessary X-rays which are generated from the X-ray generation point 35 in a predetermined direction Ac including the cathode assembly 11 in the vicinity of the X-ray generation point 35. Therefore, the amount (weight) of X-ray shielding member used is less than that of a shielding portion 61 for shielding in the housing 14. Similarly, the amount of X-ray shielding member used is less than that of a shielding portion 62 required for shielding unnecessary X-rays generated in the direction Ac in the vicinity of an outer surface of the envelope 13.

Figure 5:
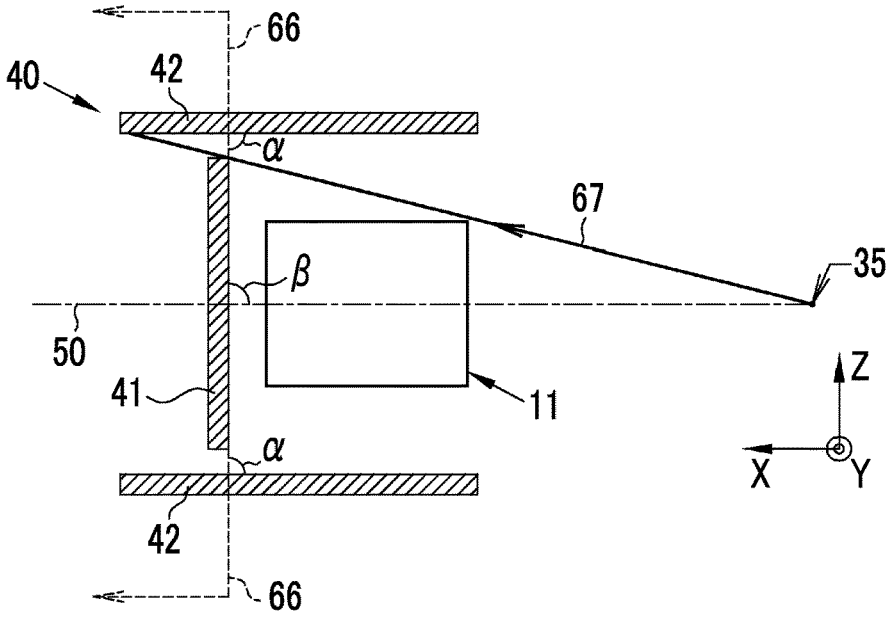
FIG. 5 is a cross-sectional view illustrating a shielding portion in which a first shielding portion and a second shielding portion are separated from each other.

In the first embodiment, the first shielding portion 41 and the second shielding portion 42 are bonded to form the shielding portion 40. However, the first shielding portion 41 and the second shielding portion 42 may be separated from each other. For example, as illustrated in FIG. 5, the first shielding portion 41 and the second shielding portion 42 may be separated from each other in a state in which the angle α formed between the first shielding portion 41 and the second shielding portion 42 is 90 degrees and the angle β formed between the reference line 50 and the first shielding portion 41 is 90 degrees. In this case, it is preferable that the second shielding portion 42 protrudes behind the first shielding portion 41. The term "behind the first shielding portion 41" means a space that is closer to the envelope 13 than a plane 66 including an intersection point between the reference line 50 and the first shielding portion 41 between the cathode assembly 11 and the envelope 13. In a case in which the second shielding portion 42 protrudes behind the first shielding portion 41, the second shielding portion 42 can shield unnecessary X-rays transmitted between the first shielding portion 41 and the second shielding portion 42 as represented by an arrow 67.

Figure 6:
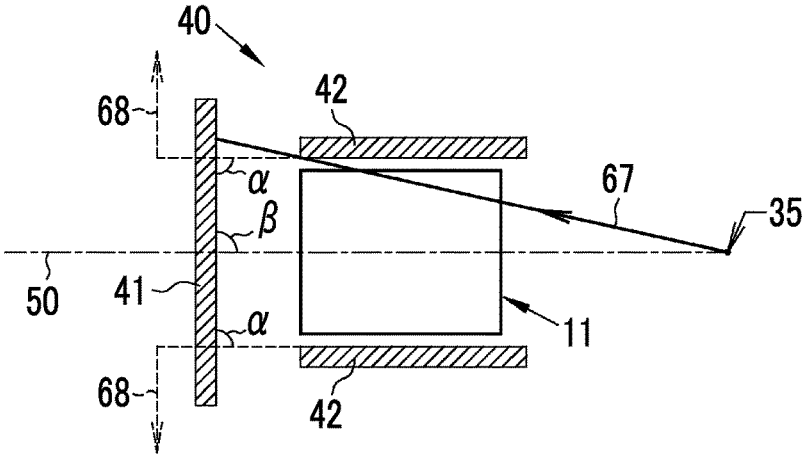
FIG. 6 is a cross-sectional view illustrating another shielding portion in which a first shielding portion and a second shielding portion are separated from each other.

Further, in a case in which the first shielding portion 41 and the second shielding portion 42 are separated from each other, the first shielding portion 41 may protrude from the second shielding portion 42, instead of the configuration in which the second shielding portion 42 protrudes behind the first shielding portion 41, as illustrated in FIG. 6. The "protrusion of the first shielding portion 41 from the second shielding portion 42" means that the first shielding portion 41 continuously extends to the envelope 13 from an extension line of an inner surface of the second shielding portion 42, as represented by an arrow 68. As such, in a case in which the shielding portion 40 is configured such that the first shielding portion 41 protrudes from the second shielding portion 42, the first shielding portion 41 can shield unnecessary X-rays transmitted between the first shielding portion 41 and the second shielding portion 42 as represented by the arrow 67. In FIG. 6, the angle α formed between the first shielding portion 41 and the second shielding portion 42 is 90 degrees and the angle β formed between the reference line 50 and the first shielding portion 41 is 90 degrees.

Figure 7:
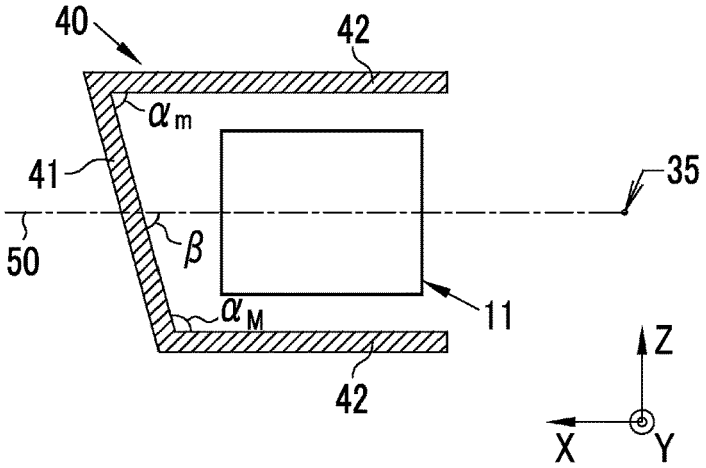
FIG. 7 is a cross-sectional view illustrating a shielding portion including an inclined first shielding portion.

In the first embodiment and the modification examples, the angle β formed between the reference line 50 and the first shielding portion 41 is 90 degrees. However, as illustrated in FIG. 7, the shielding portion 40 may be configured such that the first shielding portion 41 is inclined with respect to the reference line 50. This holds for the configuration in which the first shielding portion 41 and the second shielding portion 42 are separated from each other. In this case, the angle β formed between the reference line 50 and the first shielding portion 41 is less than 90 degrees. In addition, in a case in which the second shielding portion 42 is parallel to the reference line 50, the angle α formed between the first shielding portion 41 and the second shielding portion 42 is not constant and a maximum value $\alpha_M$ of the angle α formed between the first shielding portion 41 and the second shielding portion 42 is greater than 90 degrees and less than 180 degrees. In addition, a minimum value $\alpha_m$ of the angle α formed between the first shielding portion 41 and the second shielding portion 42 is less than 90 degrees.

Figure 8:
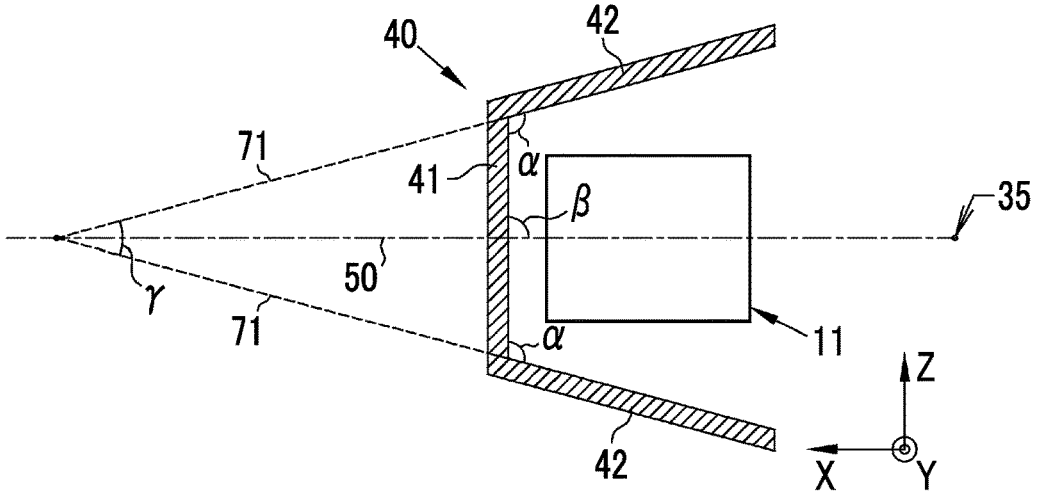
FIG. 8 is a cross-sectional view illustrating a shielding portion including an inclined second shielding portion.

In the above-described modification example, the first shielding portion 41 is inclined with respect to the reference line 50. However, as illustrated in FIG. 8, the shielding portion 40 may be configured such that the second shielding portion 42 may be inclined with respect to the reference line 50. The "inclination of the second shielding portion 42 with respect to the reference line 50" means that a portion or the whole of the second shielding portion 42 is not parallel to the reference line 50. In FIG. 8, the second shielding portion 42 has a horn shape in which an opening is uniformly spread toward the X-ray generation point 35 (anode 12). Therefore, a plane 71 extending from the inner surface (a surface facing the cathode assembly 11) of the second shielding portion 42 in FIG. 8 is converged on one point on the reference line 50 and the central angle γ of the plane 71 is greater than 0 degrees. In addition, in FIG. 8, the angle α formed between the first shielding portion 41 and the second shielding portion 42 is greater than 90 degrees and less than 180 degrees. Further, the angle β formed between the reference line 50 and the first shielding portion 41 is 90 degrees. Of course, the opening of the second shielding portion 42 may be non-uniformly spread or narrowed.

Figure 9:
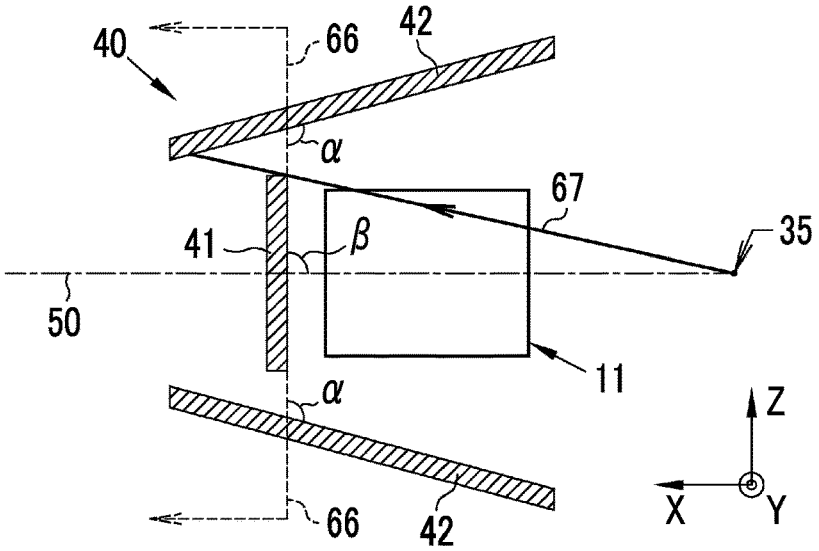
FIG. 9 is a cross-sectional view illustrating a shielding portion in which a first shielding portion and a second shielding portion are separated from each other.

As described above, in a case in which the first shielding portion 41 is inclined with respect to the reference line 50 and in a case in which a portion or the whole of the second shielding portion 42 is inclined with respect to the reference line 50, the shielding portion 40 can be configured such that the first shielding portion 41 and the second shielding portion 42 are separated from each other. For example, as illustrated in FIG. 9, the shielding portion 40 may be configured such that the first shielding portion 41 perpendicular to the reference line 50 and the second shielding portion 42 having a horn shape are separated from each other. In this case, it is preferable that the second shielding portion 42 protrudes behind the first shielding portion 41. In this case, as represented by the arrow 67, the second shielding portion 42 can shield unnecessary X-rays transmitted between the first shielding portion 41 and the second shielding portion 42. In FIG. 9, the angle α formed between the first shielding portion 41 and the second shielding portion 42 is greater than 90 degrees and less than 180 degrees and the angle β formed between the reference line 50 and the first shielding portion 41 is 90 degrees.

Figure 10:
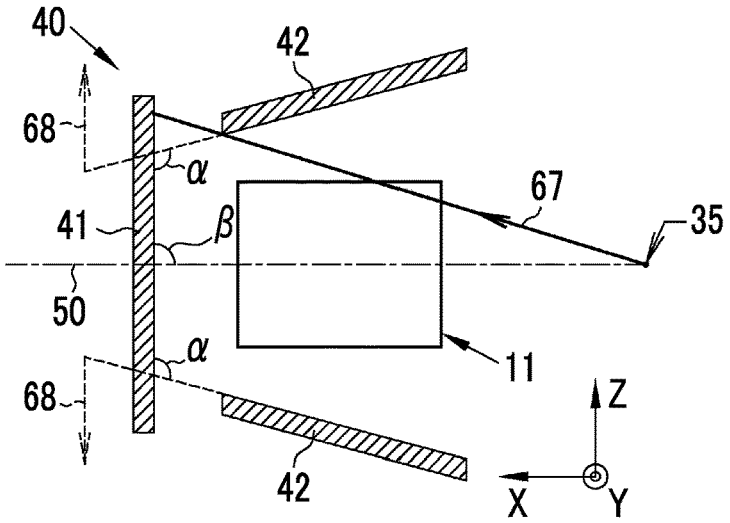
FIG. 10 is a cross-sectional view illustrating a shielding portion in which a first shielding portion and a second shielding portion are separated from each other.

In a case in which the first shielding portion 41 perpendicular to the reference line 50 and the second shielding portion 42 having a horn shape are separated from each other as illustrated in FIG. 10, the first shielding portion 41 may protrude from the second shielding portion 42. In this case, as represented by the arrow 67, the first shielding portion 41 can shield unnecessary X-rays transmitted between the first shielding portion 41 and the second shielding portion 42.

In a case in which the second shielding portion 42 is formed in a horn shape or other shapes in which it has a part that is not parallel to the reference line 50, it is preferable that at least a part of the second shielding portion 42 is substantially perpendicular to a plane extending from the anode surface 32. The term "substantially perpendicular" means an angle close to 90 degrees (for example, an angle equal to or greater than 80 degrees and equal to or less than 100 degrees) in addition to an angle of 90 degrees.

Figure 11:
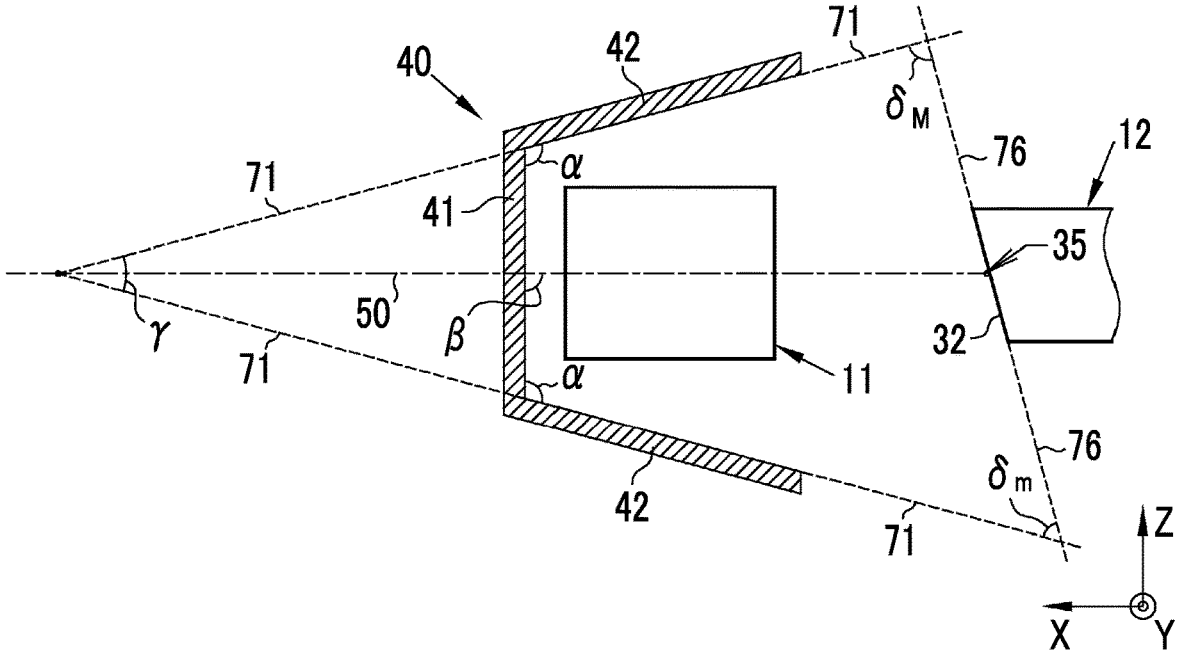
FIG. 11 is a cross-sectional view illustrating a shielding portion having a second shielding portion of which a part is perpendicular to an anode surface.

For example, in a case in which the second shielding portion 42 is formed in a horn shape, since the anode surface 32 is inclined with respect to the reference line 50, a maximum value $\delta_M$ of an angle δ formed between a plane 71 extending from the inner surface of the second shielding portion 42 and a plane 76 extending from the anode surface 32 can be greater than, for example, 90 degrees and less than 180 degrees as illustrated in FIG. 11. In addition, a minimum value $\delta_m$ of the angle δ is less than 90 degrees. For example, in a case in which the angle δ is greater than 90 degrees, it is possible to effectively shield unnecessary X-rays generated in the predetermined direction Ac including the cathode assembly 11. Therefore, it is possible to reduce the weight of the second shielding portion 42 and thus to reduce the overall weight of the shielding portion 40. As a result, it is possible to reduce the weight of the X-ray tube 10.

As described above, in a case in which the angle δ formed between the plane 71 extending from the inner surface of the second shielding portion 42 and the plane 76 extending from the anode surface 32 is almost 90 degrees in at least a part of the second shielding portion 42, it is preferable that the position where the angle δ is almost 90 degrees is opposite to an external device using X-rays such as an X-ray detection panel. That is, it is preferable that a part opposite to the usage direction 36 includes a part in which the angle δ is almost 90 degrees. The part opposite to the usage direction 36 means a part within a range in which a dashed line (for example, see FIG. 1) indicating the usage direction 36 can extend to the envelope 13 facing the use usage direction 36.

In FIG. 11, the plane 71 extending from the inner surface of the second shielding portion 42 is substantially perpendicular to the plane 76 extending from the anode surface 32 in at least a part of the second shielding portion 42. However, the reference may be the outer surface (a surface facing the envelope 13) of the second shielding portion 42. That is, a plane extending from the outer surface of the second shielding portion 42 may be substantially perpendicular to the plane 76 extending from the anode surface 32 in at least a part of the second shielding portion 42.

Figure 12:
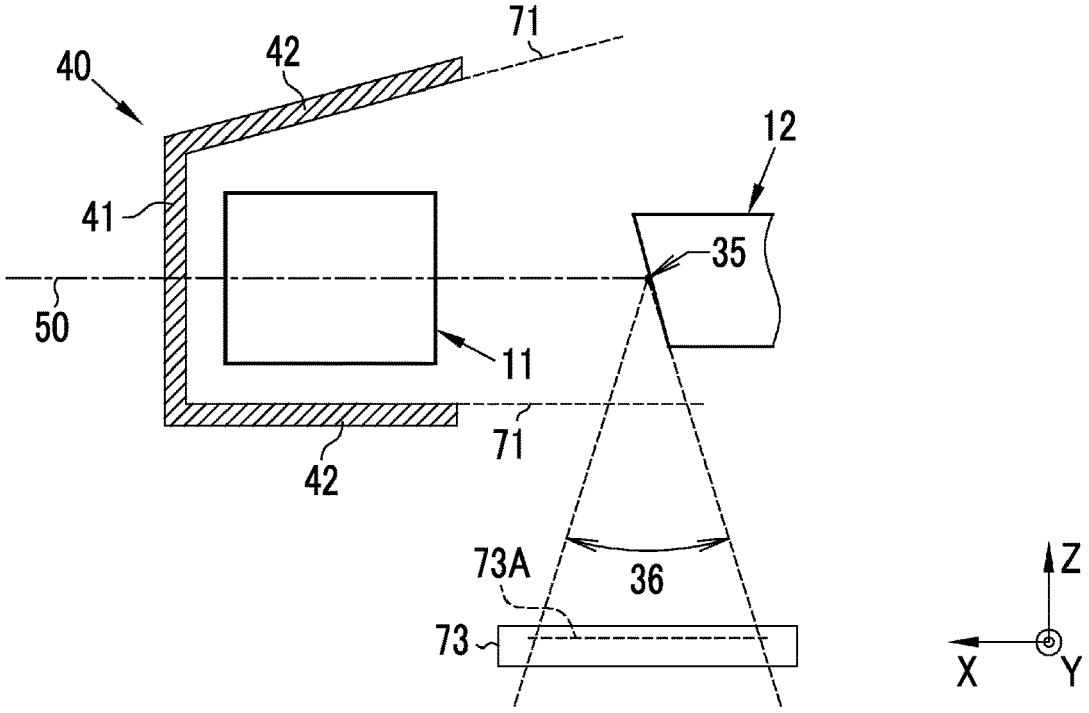
FIG. 12 is a cross-sectional view illustrating a shielding portion having a second shielding portion of which a part is parallel to an X-ray detection device.

In a case in which the second shielding portion 42 is formed in a horn shape or other shapes in which it has a part that is not parallel to the reference line 50, it is preferable that at least a part of the second shielding portion 42 is substantially parallel to the X-ray detection device. For example, as illustrated in FIG. 12, an X-ray detection panel 73 that captures an image of a subject using X-rays is a flat X-ray detection device and has a planar imaging surface 73A (for example, a photoelectric conversion surface). It is assumed that the X-ray detection panel 73 is used at a substantially predetermined position and in a substantially predetermined direction with respect to the X-ray tube 10. In this case, it is preferable that at least a part of the second shielding portion 42 or the plane 71 extending from the inner surface of the second shielding portion 42 is substantially parallel to the imaging surface 73A. Specifically, for example, it is preferable that a part of the second shielding portion 42 which is closest to the negative Z direction is substantially parallel to the imaging surface 73A. In this case, it is possible to substantially minimize the length of a part of the second shielding portion 42 which is closet to the negative Z direction. As a result, it is possible to reduce the weight of the shielding portion 40 and the X-ray tube 10.

Figure 13:
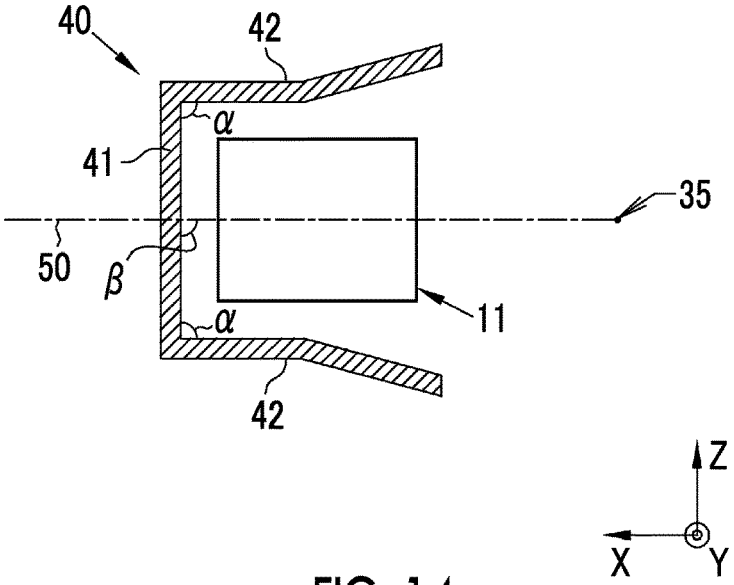
FIG. 13 is a cross-sectional view illustrating a shielding portion in which the second shielding portion is modified.

In addition to the first embodiment and the modification examples, the second shielding portion 42 can be modified in various ways. For example, as illustrated in FIG. 13, a part of the second shielding portion 42 which is close to the X-ray generation point 35 (anode 12) may be formed in a horn shape and a part of the second shielding portion 42 which is close to the cathode assembly 11 may be relatively parallel to the reference line 50. In the shielding portion 40 illustrated in FIG. 12, the angle α formed between the first shielding portion 41 (β=90 degrees) perpendicular to the reference line 50 and the second shielding portion 42 is 90 degrees.

Figure 14:
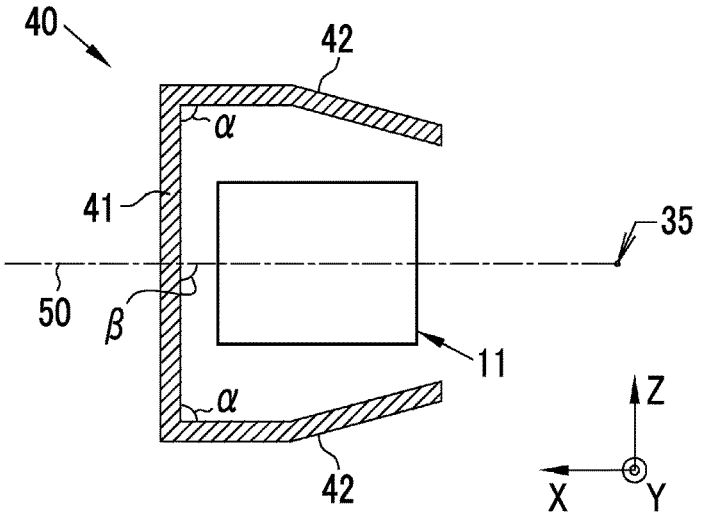
FIG. 14 is a cross-sectional view illustrating a shielding portion in which the second shielding portion is modified.

Furthermore, as illustrated in FIG. 14, a part of the second shielding portion 42 which is close to the X-ray generation point 35 (anode 12) may be formed in an inverted horn shape and a part of the second shielding portion 42 which is close to the cathode assembly 11 may be relatively parallel to the reference line 50. The inverted horn shape is a shape in which an opening is uniformly narrowed toward the X-ray generation point 35. In the shielding portion 40 illustrated in FIG. 13, the angle α formed between the first shielding portion 41 (β=90 degrees) perpendicular to the reference line 50 and the second shielding portion 42 is 90 degrees.

Figure 15:
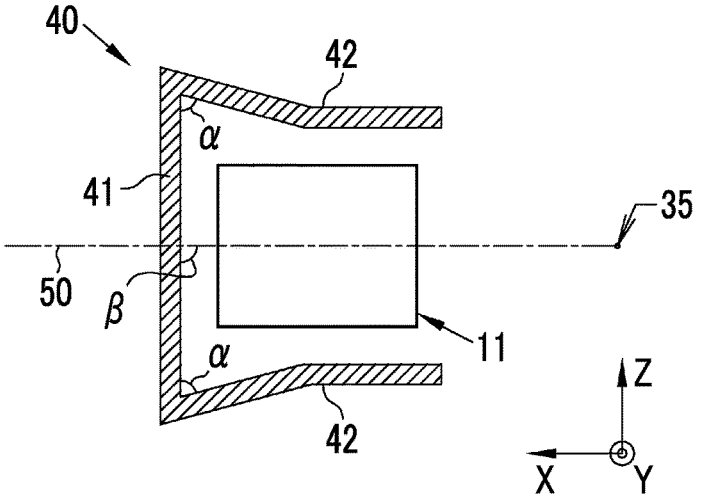
FIG. 15 is a cross-sectional view illustrating a shielding portion in which the second shielding portion is modified.
Figure 16:
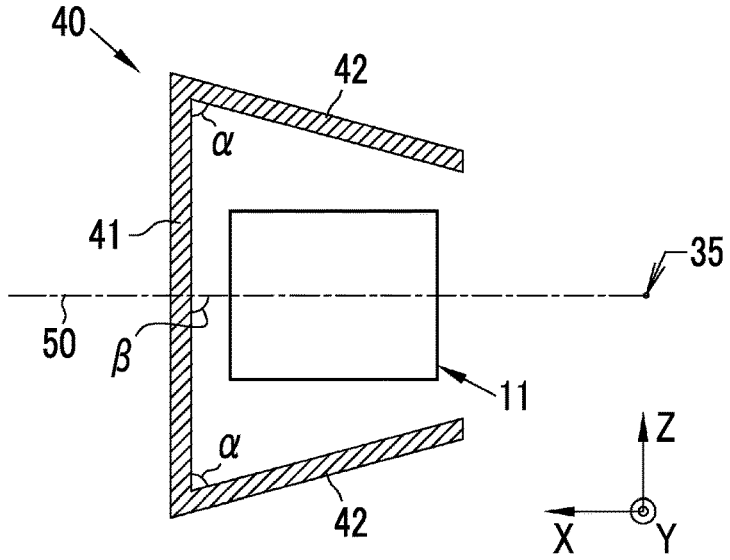
FIG. 16 is a cross-sectional view illustrating a shielding portion in which the second shielding portion is modified.

As illustrated in FIG. 15, a part of the second shielding portion 42 which is close to the cathode assembly 11 may be formed in an inverted horn shape and a part of the second shielding portion 42 which is close to the X-ray generation point 35 (anode 12) may be relatively parallel to the reference line 50. As illustrated in FIG. 16, the entire second shielding portion 42 may be formed in an inverted horn shape. In these cases, the angle α formed between the first shielding portion 41 (β=90 degrees) perpendicular to the reference line 50 and the second shielding portion 42 is less than 90 degrees.

Figure 17:
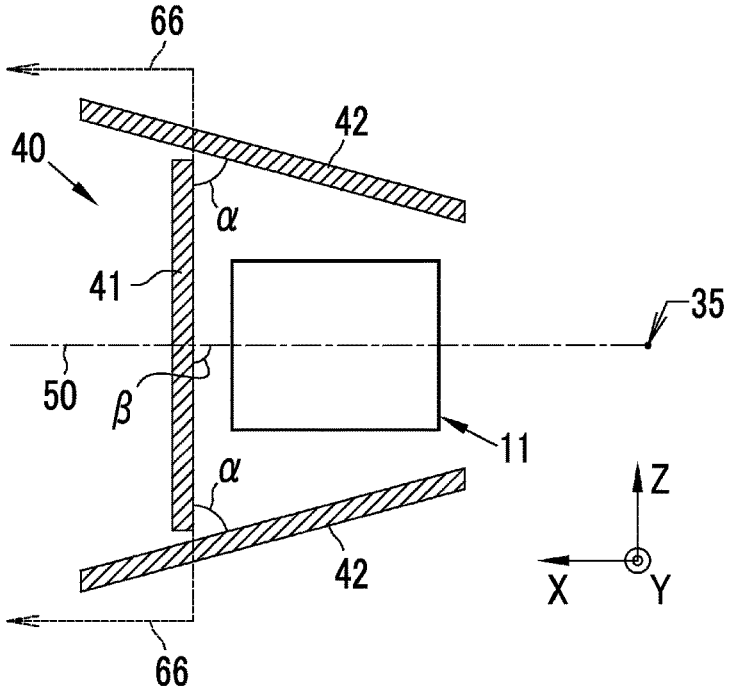
FIG. 17 is a cross-sectional view illustrating a modified shielding portion.
Figure 18:
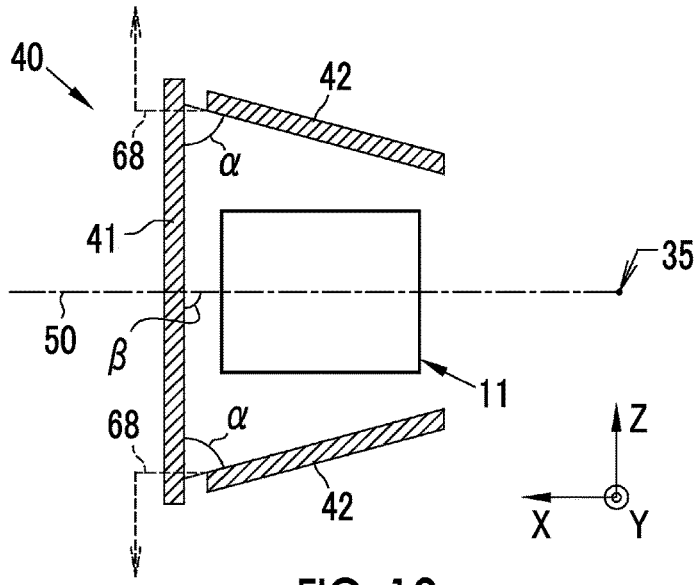
FIG. 18 is a cross-sectional view illustrating a modified shielding portion.

As described above, even in a case in which a part or the whole of the second shielding portion 42 is formed in an inverted horn shape, the shielding portion 40 can be configured such that the first shielding portion 41 and the second shielding portion 42 are separated from each other. In this case, as illustrated in FIG. 17, the second shielding portion 42 protrudes backward from the first shielding portion 41. However, it is preferable that the first shielding portion 41 protrudes from the second shielding portion 42 as illustrated in FIG. 18. In this case, the first shielding portion 41 or the second shielding portion 42 shields unnecessary X-rays transmitted between the first shielding portion 41 and the second shielding portion 42.

Figure 19:
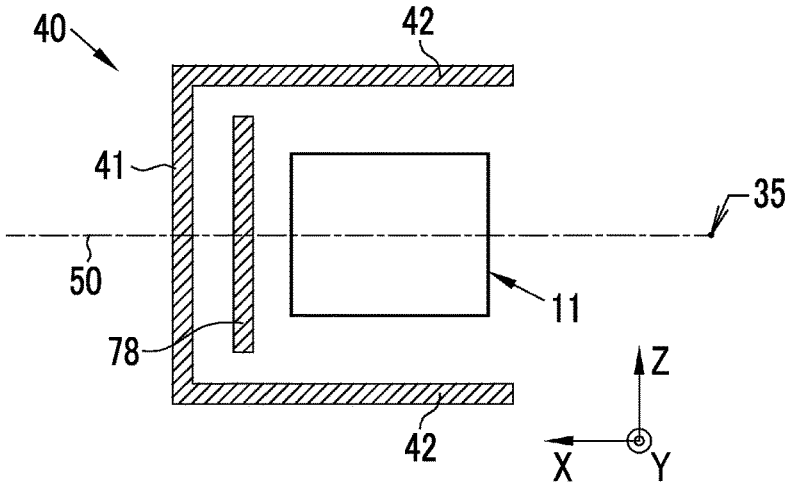
FIG. 19 is a cross-sectional view illustrating a shielding portion provided with an additional shielding member.

In the first embodiment and the modification examples, the shielding portion 40 is formed by the first shielding portion 41 and the second shielding portion 42. However, the shielding portion 40 may include other shielding members. For example, as illustrated in FIG. 19, an X-ray shielding member 78 may be additionally provided between the first shielding portion 41 and the cathode assembly 11. In this case, it is possible to more reliably shield unnecessary X-rays behind the cathode assembly 11. Similarly, a shielding member may be additionally provided between the second shielding portion 42 and the cathode assembly 11.

Figure 20:
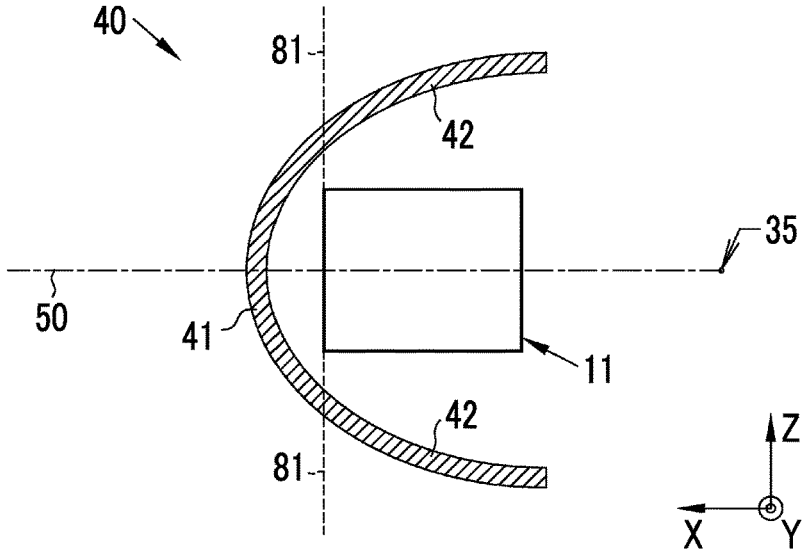
FIG. 20 is a cross-sectional view illustrating a shielding portion formed in an elliptical shape.

In the first embodiment and the modification examples, the first shielding portion 41 and the second shielding portion 42 can be clearly distinguished from each other in the shielding portion 40. However, the shielding portion 40 may be configured such that the boundary between the first shielding portion 41 and the second shielding portion 42 is ambiguous. For example, as illustrated in FIG. 20, the shielding portion 40 may be formed in, for example, a shape corresponding to a part of an ellipsoid, a hyperboloidal shape, or a hemispherical shape. In this case, a portion that is behind the cathode assembly 11, that is, a portion that is closer to the envelope 13 than a dashed line 81 is the first shielding portion 41 and the other portion is the second shielding portion 42.

Figure 21:
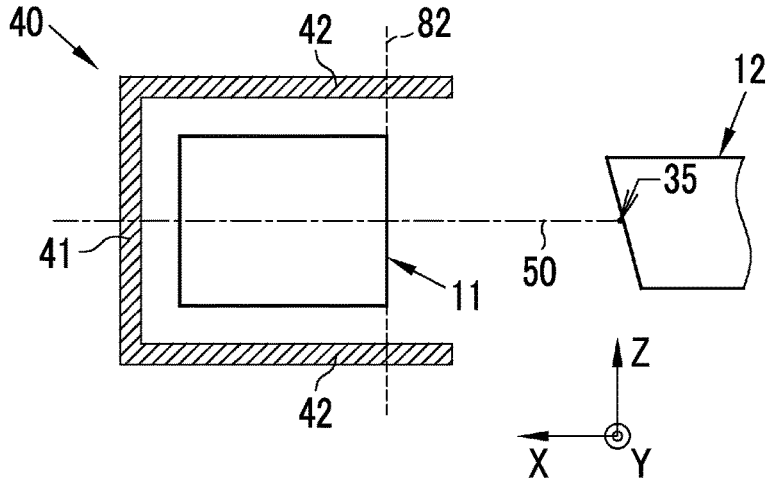
FIG. 21 is a cross-sectional view illustrating a shielding portion having a second shielding portion that protrudes toward an anode.

In the first embodiment and the modification examples, the shielding portion 40 is formed in various shapes. However, in any case, it is preferable that the second shielding portion 42 protrudes from the cathode assembly 11 to the anode 12. The term "protrusion from the cathode assembly 11 to the anode 12" means that a part or the whole of an end of the second shielding portion 42 which is close to the anode 12 continuously extends to the anode 12 from a plane 82 that includes a surface or a leading end of a member of the cathode assembly 11 which is closest to the anode 12 and is perpendicular to the reference line 50, as illustrated in FIG. 21.

Figure 22:
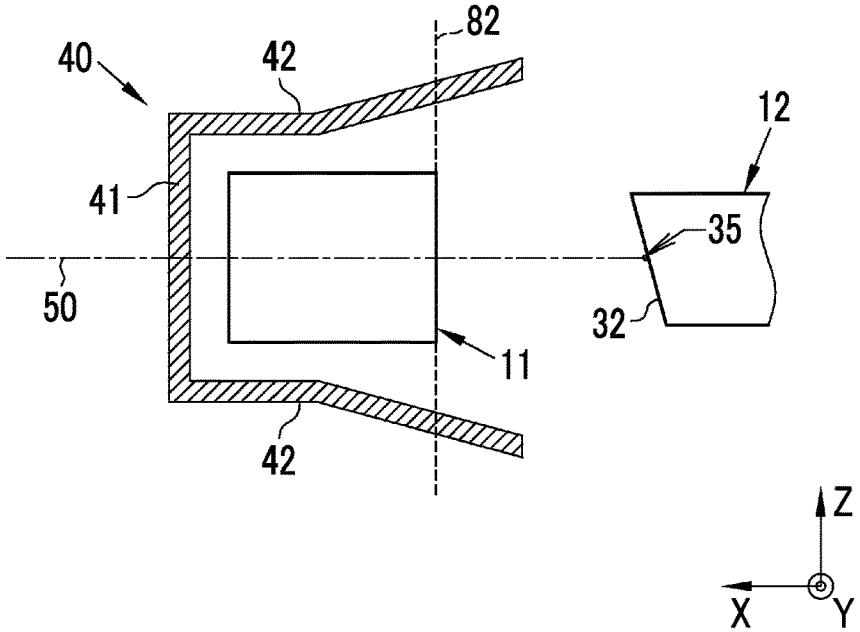
FIG. 22 is a cross-sectional view illustrating a shielding portion having a second shielding portion that protrudes toward the anode.

As described above, in a case in which the second shielding portion 42 protrudes from the cathode assembly 11 to the anode 12, it is preferable that a part of the second shielding portion 42 which is close to the anode 12 or the entire second shielding portion 42 is formed in a horn shape as illustrated in FIG. 22. In this case, since it is easy to ensure the distance between the second shielding portion 42 and the anode 12, discharge is unlikely to occur between the second shielding portion 42 and the anode 12. In addition, unnecessary X-rays can be shielded in a wide range even in a case in which the size of the second shielding portion 42 decreases to reduce the weight of the shielding portion 42. Therefore, it is possible to effectively reduce the weight of the shielding portion 40 and the X-ray tube 10.

In the shielding portions 40 according to the first embodiment and the modification examples, it is preferable that the angle α formed between the first shielding portion 41 and the second shielding portion 42 is 90 degrees. In a case in which the angle α formed between the first shielding portion 41 and the second shielding portion 42 is not uniform, it is preferable that some or all of the angles α formed between the first shielding portion 41 and the second shielding portion 42 are 90 degrees. In this case, it is easy to manufacture the shielding portions 40. In addition, the angles α formed between the first shielding portion 41 and the second shielding portion 42 may be greater than 90 degrees and less than 180 degrees. In a case in which the angle α formed between the first shielding portion 41 and the second shielding portion 42 is not uniform, it is preferable that some or all of the angles α formed between the first shielding portion 41 and the second shielding portion 42 are greater than 90 degrees and less than 180 degrees. In this case, it is easy to reduce the size of the second shielding portion 42. As a result, it is possible to reduce the weight of the shielding portion 40 and the X-ray tube 10. Of course, for example, as in the shielding portion 40 illustrated in FIG. 15, the angle α formed between the first shielding portion 41 and the second shielding portion 42 may be less than 90 degrees. In a case in which the angles α formed between the first shielding portion 41 and the second shielding portion 42 are not uniform, some or all of the angles α may be less than 90 degrees. In addition, in a case in which the angle α formed between the first shielding portion 41 and the second shielding portion 42 is less than 90 degrees, it is possible to reduce the angle α in the range in which the X-ray tube 10 operates. In this case, it may be easy to manufacture the shielding portion 40 while avoiding, for example, physical or electrical interference. For example, the limited angle α at which the X-ray tube 10 does not operate due to physical or electrical interference or other practical reasons is the lower limit of the angle α formed between the first shielding portion 41 and the second shielding portion 42. The lower limit of the angle α is, for example, about 30 degrees to 60 degrees.

Further, in a case in which the angles α formed between the first shielding portion 41 and the second shielding portion 42 are not uniform, the angles α may include an angle of 90 degrees and an angle that is greater than 90 degrees and less than 180 degrees. In this case, it is possible to obtain both the effect of easily manufacturing the shielding portion 40 and the effect of reducing the size of the second shielding portion 42 and thus reducing the weight of the shielding portion 40 and the X-ray tube 10.

Furthermore, in a case in which the angles α formed between the first shielding portion 41 and the second shielding portion 42 are not uniform, the angles α may include an angle of 90 degrees and an angle of less than 90 degrees. In this case, it is possible to easily manufacture the shielding portion 40 while avoiding physical interference with, for example, other members.

In addition, in a case in which the angles α formed between the first shielding portion 41 and the second shielding portion 42 are not uniform, the angles α may include an angle that is greater than 90 degrees and less than 180 degrees and an angle of less than 90 degrees. In this case, it is possible to obtain both the effect of reducing the size of the second shielding portion 42 and thus reducing the weight of the shielding portion 40 and the X-ray tube 10 and the effect of easily manufacturing the shielding portion 40 while avoiding, for example, physical interference with other members.

Furthermore, in a case in which the angles α formed between the first shielding portion 41 and the second shielding portion 42 are not uniform, the angles α may include an angle of 90 degrees, an angle that is greater than 90 degrees and less than 180 degrees, and an angle of less than 90 degrees. In this case, the following effects may be obtained: the effect of easily manufacturing the shielding portion 40; the effect of reducing the size of the second shielding portion 42 and thus reducing the weight of the shielding portion 40 and the X-ray tube 10; and the effect of avoiding, for example, physical interference with other members.

Second Embodiment

Figure 23:
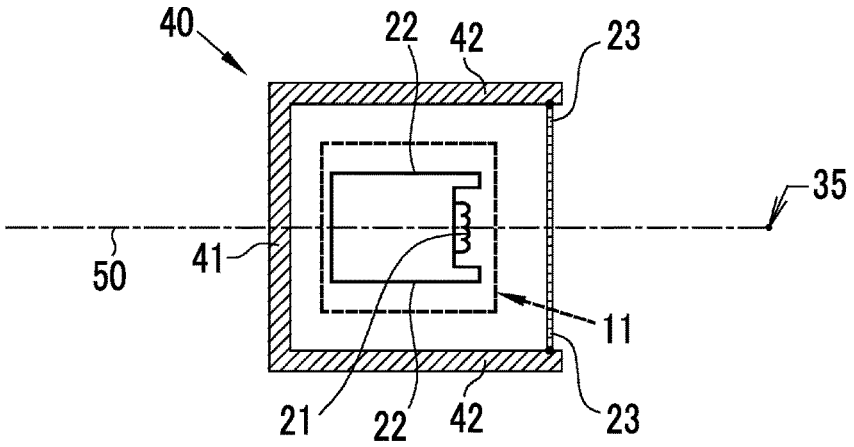
FIG. 23 is a cross-sectional view illustrating a shielding portion having a second shielding portion that is electrically connected to a second electrode.

In the first embodiment and the modification examples, the first electrode 22 and the second electrode 23 are not electrically connected to the first shielding portion 41 and the second shielding portion 42. However, the first shielding portion 41 or the second shielding portion 42 can be electrically connected to the first electrode 22 or the second electrode 23. That is, the X-ray tube 10 may comprise an electrode that is electrically connected to the first shielding portion 41 or the second shielding portion 42. For example, as illustrated in FIG. 23, the second shielding portion 42 is electrically connected to the second electrode 23. In this case, the second electrode 23 is an electrode that is electrically connected to the second shielding portion 42. In addition, in FIG. 23, the first shielding portion 41 and the second shielding portion 42 are bonded and electrically connected to each other. Therefore, the second electrode 23 electrically connected to the second shielding portion 42 is an electrode that is electrically connected to the first shielding portion 41. Of course, the first shielding portion 41 and the second electrode 23 may be directly electrically connected to each other. This holds for the shielding portion 40 in which the first shielding portion 41 and the second shielding portion 42 are separated from each other.

Figure 24:
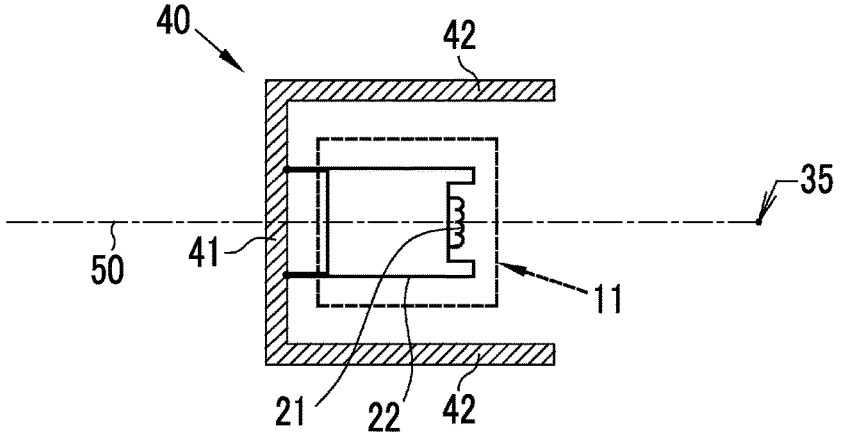
FIG. 24 is a cross-sectional view illustrating a shielding portion having a first shielding portion that is electrically connected to a first electrode.

As illustrated in FIG. 24, the first shielding portion 41 and the first electrode 22 may be electrically connected to each other. In this case, the first electrode 22 is an electrode that is electrically connected to the first shielding portion 41. In a case in which the first shielding portion 41 and the second shielding portion 42 are electrically connected to each other, the first electrode 22 electrically connected to the first shielding portion 41 is an electrode that is electrically connected to the second shielding portion 42. Of course, the second shielding portion 42 and the first electrode 22 may be directly electrically connected to each other. This holds for the shielding portion 40 in which the first shielding portion 41 and the second shielding portion 42 are separated from each other.

As described above, in a case in which the first electrode 22 or the second electrode 23 is electrically connected to the first shielding portion 41 or the second shielding portion 42, a predetermined voltage is applied to the first electrode 22 or the second electrode 23 by the first shielding portion 41 or the second shielding portion 42 to form a necessary electric field on or in the vicinity of the orbit of electrons. In addition, the support portion 39 for the shielding portion 40 (the first shielding portion 41 or the second shielding portion 42) and wires for the first electrode 22 or the second electrode 23 can be used in common.

Electrodes other than the first electrode 22 and the second electrode 23 may be connected to the first shielding portion 41 or the second shielding portion 42. In addition, in the case of the shielding portion 40 in which the first shielding portion 41 and the second shielding portion 42 are separated from each other, different electrodes may be electrically connected to the first shielding portion 41 and the second shielding portion 42. For example, the first electrode 22 is electrically connected to the first shielding portion 41 and the second electrode 23 is electrically connected to the second shielding portion 42.

Third Embodiment

Figure 25:
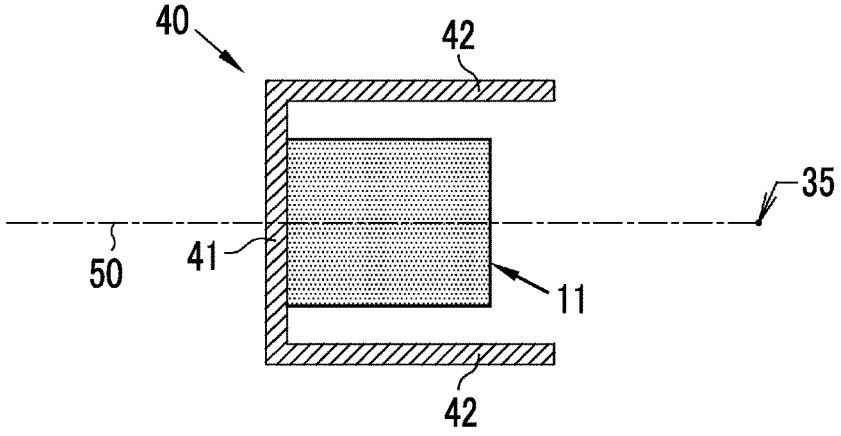
FIG. 25 is a cross-sectional view illustrating a shielding portion having a first shielding portion that is bonded to the cathode assembly.
Figure 26:
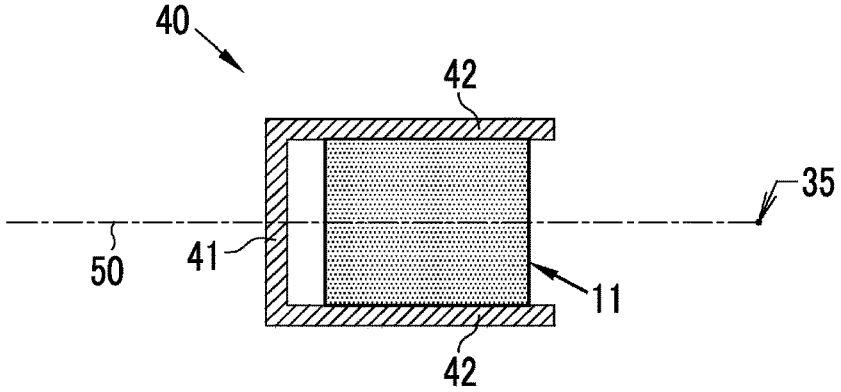
FIG. 26 is a cross-sectional view illustrating a shielding portion having a second shielding portion that is bonded to the cathode assembly.
Figure 27:
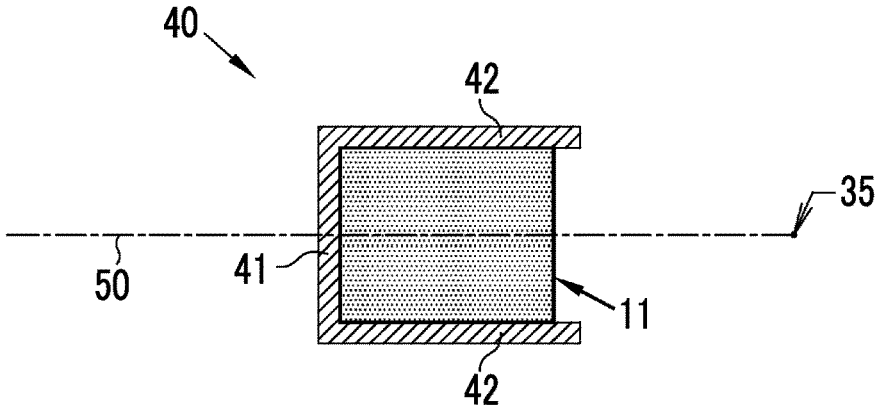
FIG. 27 is a cross-sectional view illustrating a shielding portion having a first shielding portion and a second shielding portion that are bonded to the cathode assembly.

In the first and second embodiments and the modification examples, the first shielding portion 41 and the second shielding portion 42 are not bonded to the cathode assembly 11. However, a portion or the whole of the first shielding portion 41 and/or the second shielding portion 42 may be bonded to the cathode assembly 11. In this embodiment, adhesion means that components come into contact with each other and the positional relationship between the components is substantially fixed by welding, fitting, or other methods, in addition to bonding using an adhesive. For example, as illustrated in FIG. 25, the first shielding portion 41 and the cathode assembly 11 can be bonded to each other. In addition, as illustrated in FIG. 26, the second shielding portion 42 and the cathode assembly 11 can be bonded to each other. Further, as illustrated in FIG. 27, the first shielding portion 41 and the second shielding portion 42 can be bonded to the cathode assembly 11. In a case in which the first shielding portion 41 and/or the second shielding portion 42 is bonded to the cathode assembly 11, the support portion 39 for the first shielding portion 41 and/or the second shielding portion 42 can be removed, which makes it easy to manufacture the X-ray tube. This holds for the case in which the first shielding portion 41 and the second shielding portion 42 are separated from each other.

In a case in which the first shielding portion 41 or the second shielding portion 42 is electrically connected to the first electrode 22 or the second electrode 23 as in the second embodiment, insulation is required at necessary positions.

Fourth Embodiment

Figure 28:
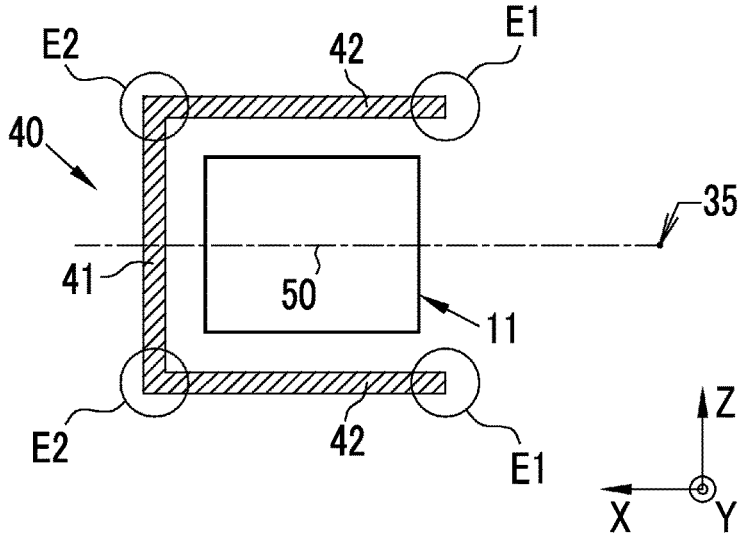
FIG. 28 is a diagram illustrating the edges of the first shielding portion and the second shielding portion.
Figure 29:
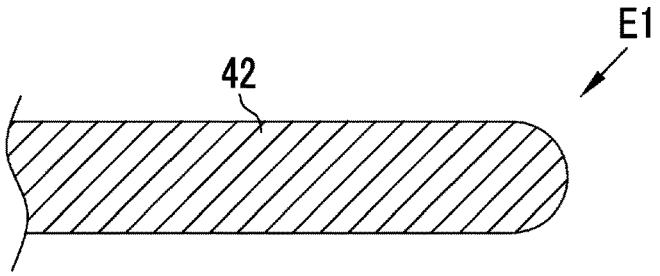
FIG. 29 is a diagram illustrating a rounded opening end.
Figure 30:
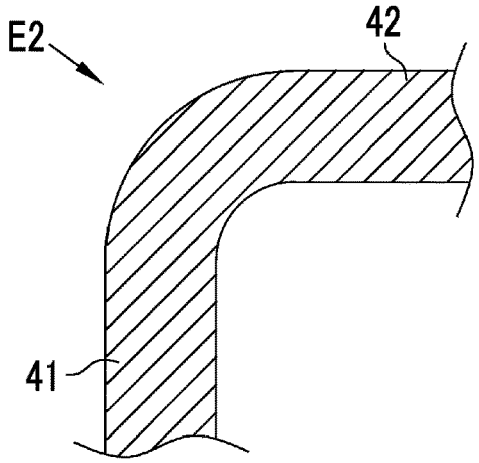
FIG. 30 is a diagram illustrating a rounded connection portion.

It is preferable that the edge of the first shielding portion 41 and/or the second shielding portion 42 is rounded. The edge of the first shielding portion 41 and/or the second shielding portion 42 is an opening end E1 formed by the second shielding portion 42 or a connection portion E2 between the first shielding portion 41 and the second shielding portion 42 as illustrated in FIG. 28. The term "rounding" means forming a substantially smooth curved surface and includes a case in which a connection angle between two or more planes forming a ridge, a vertex, or a valley is greater than 90 degrees by, for example, chamfering. For example, as illustrated in FIGS. 29 and 30, it is preferable that the opening end E1 and/or the connection portion E2 is a smooth curved surface having a predetermined curvature. In this case, it is possible to prevent discharge caused by electric field concentration. In general, in a case in which abnormal discharge is detected, the X-ray tube 10 comes to an emergency stop for safety and it takes a lot of time and effort to generate X-rays again. In addition, since the shielding portion 40 is conductive and is provided in the envelope 13, abnormal discharge is more likely to occur than that in a case in which an X-ray shielding member is provided only outside the envelope 13. However, in a case in which the edge of the first shielding portion 41 and/or the second shielding portion 42 is rounded, it is possible to obtain both the effect of shielding unnecessary X-rays using the light shielding portion 40 and the effect of preventing abnormal discharge.

In a case in which the first shielding portion 41 and/or the second shielding portion 42 has a plurality of edges, one or more of the edges may be rounded. In this case, at least the rounded edges can prevent discharge caused by electric field concentration. In addition, one edge of the first shielding portion 41 and/or the second shielding portion 42 does not need to be entirely rounded and may be partially rounded. In this case, it is possible to prevent discharge caused by electric field concentration in at least the rounded part. In a case in which these configurations are combined with each other, at least a part of the edge of the first shielding portion 41 and/or the second shielding portion 42 may be rounded. At least a part of the edge of the first shielding portion 41 and/or the second shielding portion 42 is a part of one of the edges of the first shielding portion 41 or a part of one of the edges of the second shielding portion 42.

Figure 31:
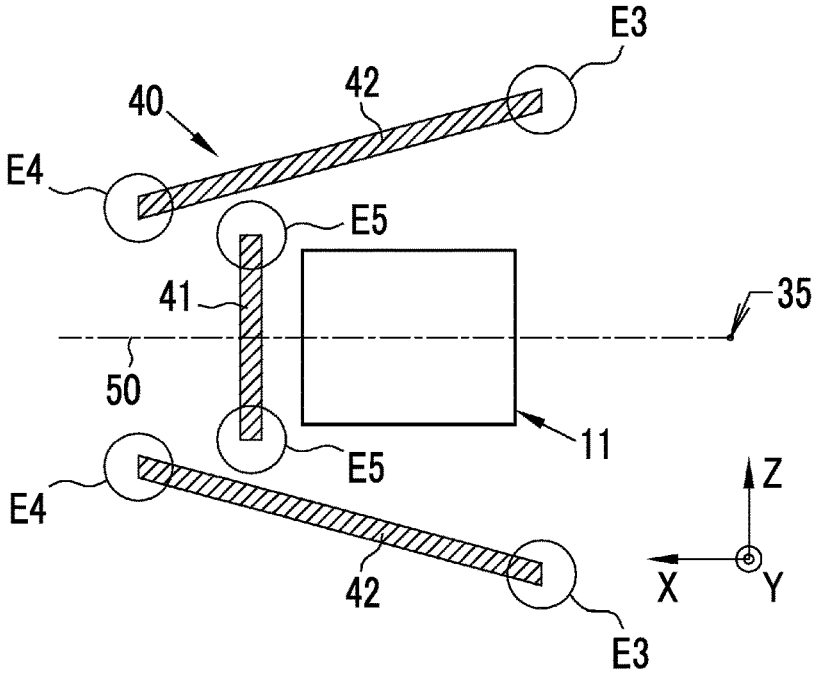
FIG. 31 is a diagram illustrating edges in a case in which the first shielding portion and the second shielding portion are separated from each other.

In a case in which the first shielding portion 41 and the second shielding portion 42 are separated from each other, the edge of the first shielding portion 41 and/or the second shielding portion 42 is an end of the first shielding portion 41 and/or an end of the second shielding portion 42. For example, as illustrated in FIG. 31, in a case in which the first shielding portion 41 and the second shielding portion 42 are separated from each other, the second shielding portion 42 has two types of edges, that is, an edge E3 forming an opening which is close to the anode 12 and an edge E4 forming an opening on the side where the first shielding portion 41 is present with respect to the cathode assembly 11. The first shielding portion 41 has one type of edge E5.

In this case, it is particularly preferable that at least the edge E3 is rounded. The reason is that, since the edge E3 is close to the anode 12 having a particularly large potential difference from the edge E3, discharge is likely to occur between the edge E5 and the anode 12. It is preferable that the edge E5 is rounded. This is because discharge is likely to occur between the edge E5 and the second shielding portion 42, according to, for example, the distance and insulation state between the edge E5 of the first shielding portion 41 and the second shielding portion 42.

Fifth Embodiment

In a case in which the shielding portion 40 according to each of the above-described embodiments and modification examples is provided, it is preferable that a shielding member (hereinafter, referred to as a tube wall shielding member) which shields X-rays is provided on a portion of the envelope 13 which X-rays (unnecessary X-rays) reaches. In this case, unnecessary X-rays that are not capable of being shielded by the shielding portion 40 are shielded by the inner surface or the outer surface of the envelope 13. In a case in which the tube wall shielding member is provided, the weight of the X-ray tube 10 can be less than that in a case in which the X-ray shielding member is provided in the housing 14 for the same purpose.

Figure 32:
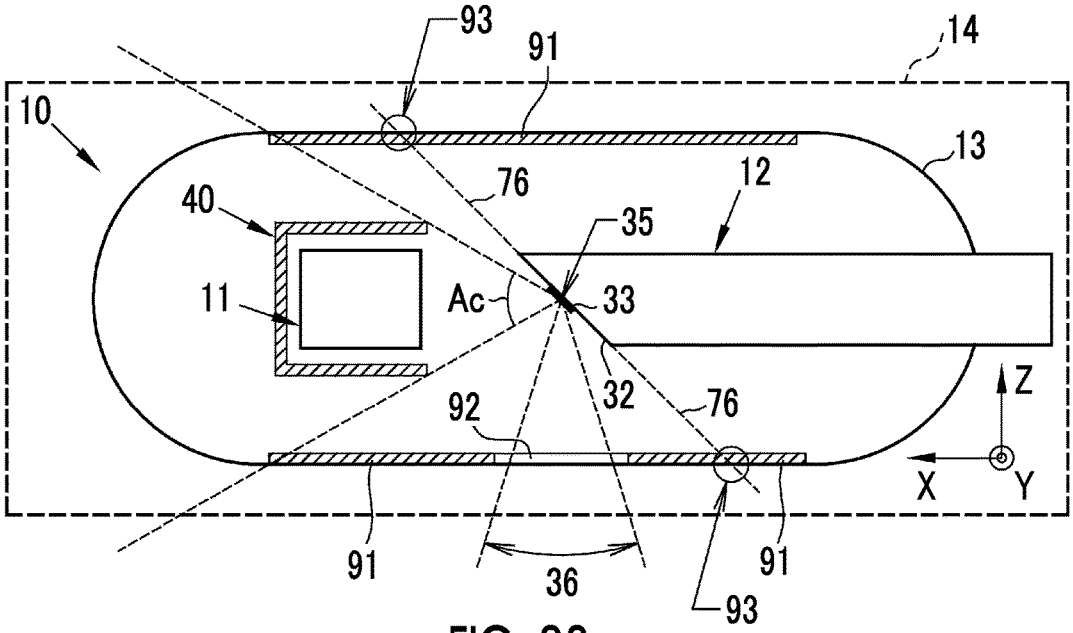
FIG. 32 is a cross-sectional view illustrating an X-ray tube provided with a tube wall shielding member.

Specifically, as illustrated in FIG. 32, a tube wall shielding member 91 is provided on at least a portion of the envelope 13 in which unnecessary X-rays are not shielded by the first shielding portion 41 and the second shielding portion 42. The portion of the envelope 13 in which unnecessary X-rays are not shielded by the first shielding portion 41 and the second shielding portion 42 is a portion or the whole of the inner surface or the outer surface of the envelope 13 which is not included in the predetermined direction Ac including the cathode assembly 11 from the X-ray generation point 35 and the usage direction 36. For example, an opening 92 (X-ray transmission window) or a cutout is formed in a portion of the tube wall shielding member 91 which is included in the usage direction 36 so as not to hinder the use of X-rays. In addition, it is preferable that the tube wall shielding member 91 is provided in at least a portion 93 in which the plane 76 extending from the anode surface 32 and the envelope 13 intersect each other. That is, it is preferable that the tube wall shielding member 91 is provided on the envelope 13 so as to overlap a portion or the whole of the plane 76 extending from the anode surface 32. The reason is that, in a case in which a constant distance is ensured between the shielding portion 40 and the anode 12 to avoid discharge, unnecessary X-rays are most unlikely to be shielded by the shielding portion 40 in the portion 93.

Sixth Embodiment

Figure 33:
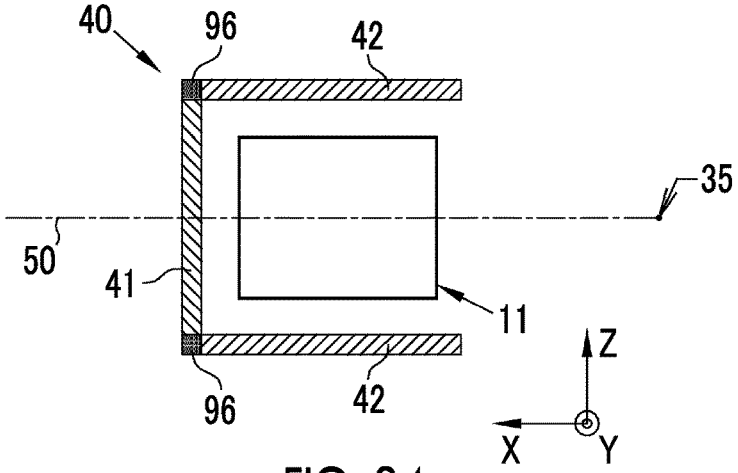
FIG. 33 is a cross-sectional view illustrating a shielding portion in which a first shielding portion and a second shielding portion are made of different materials.

As illustrated in FIG. 33, the first shielding portion 41 and the second shielding portion 42 may be made of different materials. The different materials mean materials in which elements (or combinations of elements) of components are different or materials in which combinations of the same elements are the same, but the composition ratios of the elements are different from each other. In addition, in a case in which the first shielding portion 41 and the second shielding portion 42 are bonded to each other, a material forming the bonding portion 96 may be different from the material forming the first shielding portion 41 and/or the second shielding portion 42.

For example, in a case in which the first shielding portion 41 and the second shielding portion 42 are made of different materials, it is preferable that the first shielding portion 41 is made of a material, such as molybdenum or tungsten, which is hard and is relatively difficult to process, but has a high X-ray shielding performance. The reason is that, since the first shielding portion 41 has a shape easy to process, such as a disk shape, greater importance can be attached to the X-ray shielding performance than to workability. It is preferable that the second shielding portion 42 is made of a material having easier workability than the material forming the first shielding portion 41. The reason is that the second shielding portion 42 is processed in a more complicated shape, such as a cylindrical shape or a horn shape, than the first shielding portion 41. The easy workability means low difficulty in amputation, spreading, cutting, bending, polishing, surface coating, or other types of shape processing or surface processing.

It is preferable that, as the material forming the bonding portion 96, a material that easily connects the first shielding portion 41 and the second shielding portion 42 is selected considering each of the materials forming the first shielding portion 41 and the second shielding portion 42. In a case in which molybdenum or tungsten is used as the material forming the first shielding portion 41 and molybdenum is used as the material forming the second shielding portion 42, for example, an alloy of copper and molybdenum is used as the material forming the bonding portion 96. In this case, it is easy to weld the first shielding portion 41 and the second shielding portion 42. In addition, in a case in which the first shielding portion 41, the second shielding portion 42, and the bonding portion 96 are made of an alloy of copper and molybdenum, the first shielding portion 41 is configured such that molybdenum content is the highest to increase the X-ray shielding performance. It is assumed that the copper content of the second shielding portion 42 is higher than that of the first shielding portion 41 to improve both the X-ray shielding performance and workability. In this case, the bonding portion 96 is configured such that copper content is the highest to reduce a melting point. Therefore, it is easy to weld the first shielding portion 41 and the second shielding portion 42 using the bonding portion 96.

Seventh Embodiment

In the X-ray tubes 10 according to the first to sixth embodiments and the modification examples, the shielding portion 40 is provided in the envelope 13. However, it is possible to reduce the weight of the X-ray tube by contriving the structure of the anode 12, instead of providing the shielding portion 40 or in addition to providing the shielding portion 40.

Figure 34:
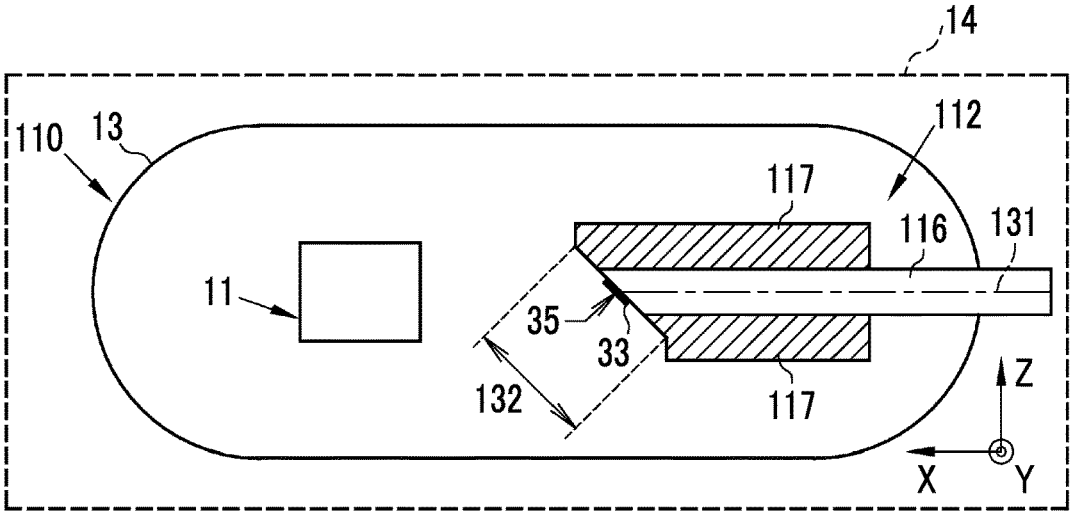
FIG. 34 is a cross-sectional view illustrating an X-ray tube that has an anode including a first member and a second member.

As illustrated in FIG. 34, an X-ray tube 110 according to this embodiment comprises an envelope 13 which is a case and a cathode assembly 11 that emits electrons in the envelope 13, similarly to the X-ray tube 10 according to, for example, the first embodiment. The X-ray tube 110 is the same as the X-ray tube 10 in that the envelope 13 is covered with the housing 14. The X-ray tube 110 comprises an anode 112 that receives the electrons emitted from the cathode assembly 11 and generates X-rays. The anode 112 of the X-ray tube 110 includes at least two types of members, that is, a first member 116 and a second member 117.

The first member 116 is a central portion of the anode 112 and at least a portion of the first member 116 extends to the outside of the envelope 13. Of the ends of the first member 116, an end that is in the envelope 13 is inclined with respect to a central axis 131 of the anode 112 and a target 33 is provided on an oblique surface of the end. Therefore, the oblique surface of the leading end of the anode 112 forms at least a portion of a surface of the anode 112 including an X-ray generation point 35, that is, an anode surface 132.

The first member 116 is made of a material with high thermal conductivity, such as copper or an alloy including copper and molybdenum. The reason is to exhaust or dissipate heat generated from the target 33 in a case in which X-rays are generated through the anode 112. The first member 116 has a higher thermal conductivity than the second member 117. In addition, for example, the diameter of the first member 116 depends on the amount of X-rays generated in the X-ray tube 110 and is preferably equal to or greater than 8 mm in order for heat exhaust or heat dissipation.

The first member 116 has an X-ray shielding performance resulting from at least its length. In particular, in a case in which the first member 116 includes, for example, molybdenum, the first member 116 has an X-ray shielding performance resulting from molybdenum. That is, the first member 116 can shield at least some of unnecessary X-rays.

The second member 117 is disposed in a direction perpendicular to the central axis 131 of the first member 116 and comes into contact with the first member 116. The direction perpendicular to the central axis 131 of the first member 116 is the side of the first member 116 between the central axis 131 and the envelope 13. In this embodiment, the second member 117 is integrated with the first member 116. That is, the second member 117 is directly connected to the first member 116 by adhesion, bonding, fitting, or other methods such that the relative positional relationship therebetween is fixed.

The second member 117 includes a material that shields X-rays, such as lead, tungsten, or molybdenum. In this embodiment, the second member 117 is made of an alloy including copper and molybdenum and has a higher molybdenum content than the first member 116. In addition, even in a case in which the first member 116 is made of an alloy including copper and molybdenum, the second member 117 has a higher molybdenum content than the first member 116. Therefore, the second member 117 has a higher specific gravity than the first member 116. Further, the second member 117 has an X-ray shielding performance and the X-ray shielding performance of the second member 117 is higher than that of the first member 116.

In the second member 117, an end that is close to the cathode assembly 11 reaches the oblique surface of the leading end of the first member 116. At least a portion of the surface of the second member 117 forms a plane that is flush with the oblique surface of the leading end of the first member 116. Therefore, a portion of the surface of the second member 117 and the oblique surface of the first member 116 form the anode surface 132.

Figure 35:
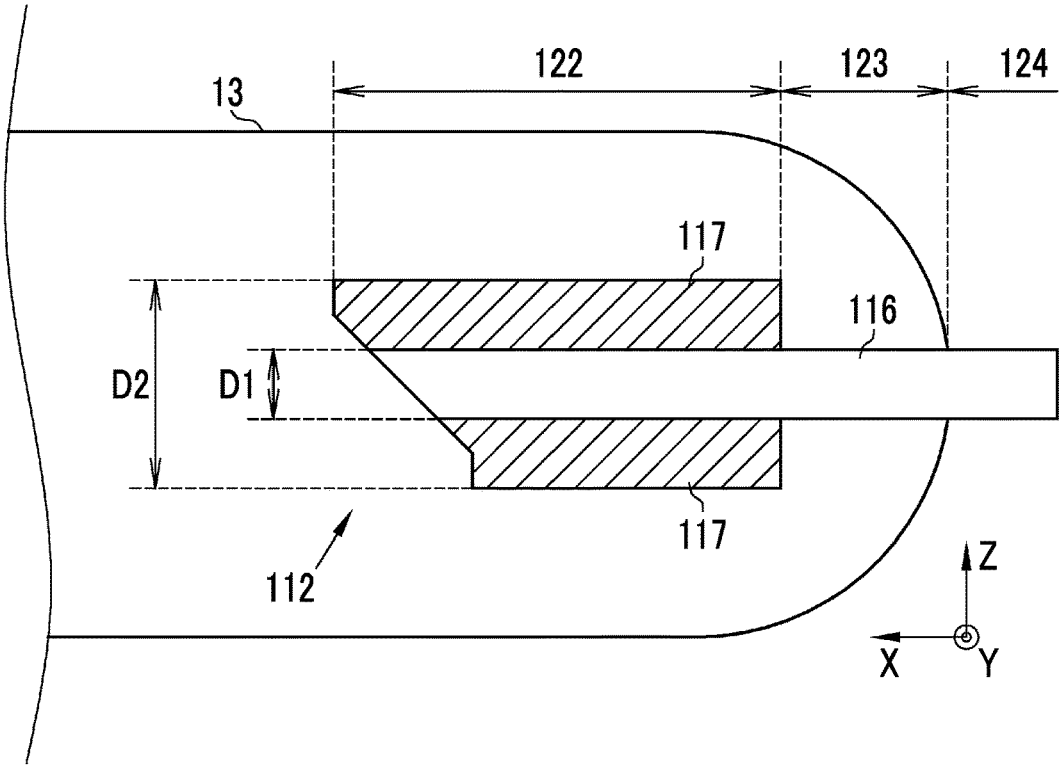
FIG. 35 is a diagram illustrating the disposition of the second member.

In addition, the second member 117 is not provided on the whole side of the first member 116, but is provided on a portion of the first member 116 which is close to the cathode assembly 11 in the envelope 13. That is, as illustrated in FIG. 35, the anode 112 has a thick portion 122 and a thin portion 123 in the envelope 13 and has an extension portion 124 outside the envelope 13. The thick portion 122 has the first member 116 and the second member 117 in the envelope 13. The thin portion 123 has the first member 116 and does not have the second member 117 in the envelope 13. In the extension portion 124, the first member 116 extends to the outside of the envelope 13. In FIG. 35, the diameter of the thick portion 122 is "D2" and the diameter of the thin portion 123 and the diameter of the extension portion 124 are "D1" (D1<D2). The above-mentioned balance between the first member 116 and the second member 117 forming the anode 112 makes it possible to effectively exhaust or dissipate heat generated from the target 33 in a case in which X-rays are generated while forming the second member 117 contributing to the shielding of unnecessary X-rays with a small size and light weight (and reducing the overall weight of the X-ray tube 110).

Figure 36:
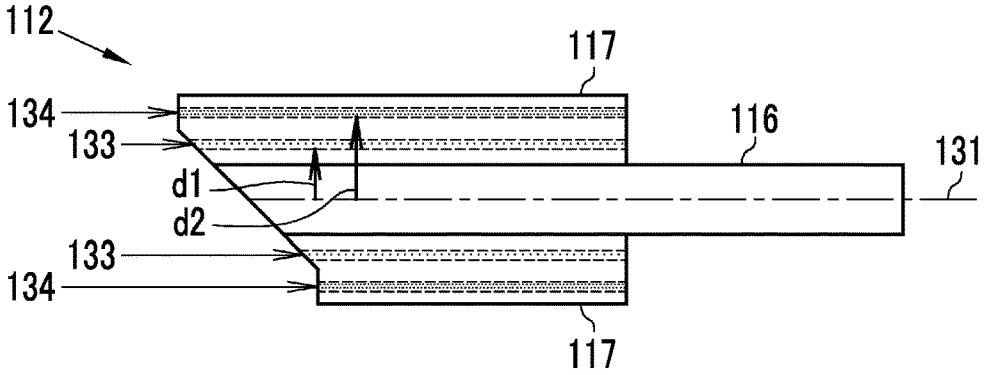
FIG. 36 is a diagram illustrating the configuration of the second member.

As illustrated in FIG. 36, the second member 117 includes a first content portion 133 whose molybdenum content is a first content and a second content portion 134 whose molybdenum content is a second content higher than the first content. A distance d2 from the first member 116 to the second content portion 134 is greater than a distance d1 from the first member 116 to the first content portion 133 (d1<d2). In this embodiment, the distance from the first member 116 is a distance from the central axis 131 to a boundary surface of the first content portion 133 or the second content portion 134 with the first member 116 for convenience. The distance from the first member 116 may be measured from a boundary surface between the first member 116 and the second member 117. In addition, the distance from the first member 116 to the first content portion 133 may be measured as a distance to a boundary surface of the first content portion 133 which is close to the envelope 13 or a distance to a predetermined position such as the center of the first content portion 133. This holds for the distance from the first member 116 to the second content portion 134.

Figure 37:
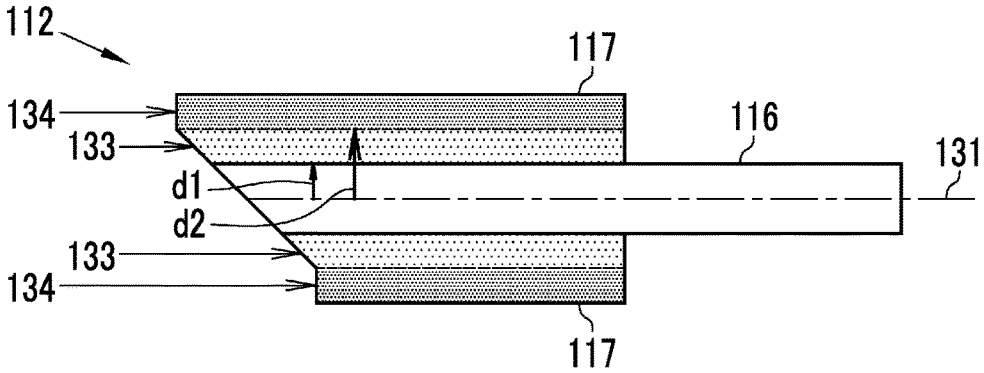
FIG. 37 is a diagram illustrating the configuration of the second member.

In FIG. 36, each of the first content portion 133 and the second content portion 134 is a portion of the second member 117. The second member 117 may include a portion whose molybdenum content is different from the molybdenum content of each of the first content portion 133 and the second content portion 134. However, as illustrated in FIG. 37, the second member 117 may include two portions, that is, the first content portion 133 and the second content portion 134.

Figure 38:
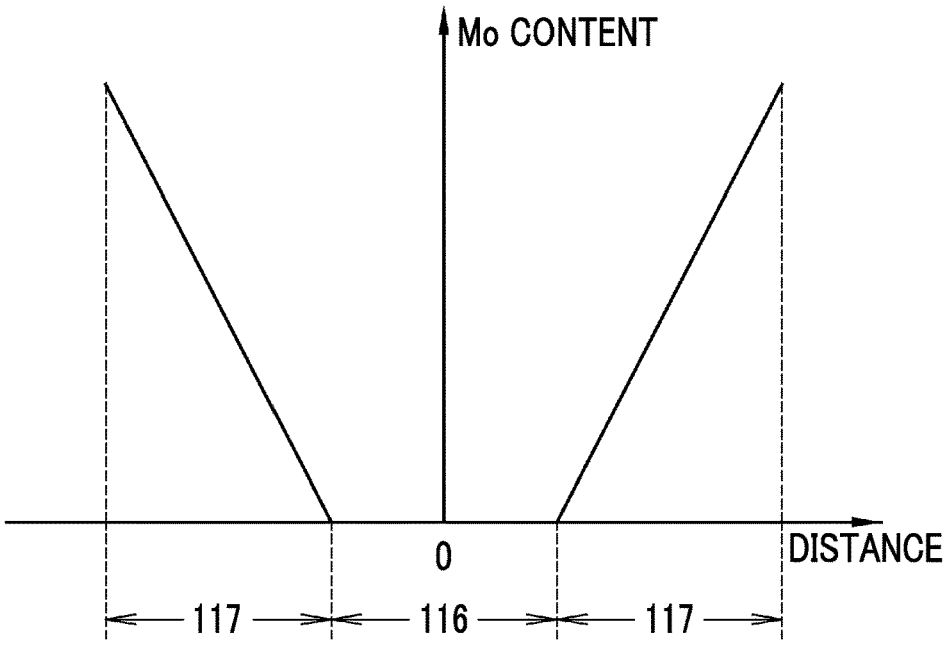
FIG. 38 is a graph illustrating molybdenum (Mo) content.
Figure 39:
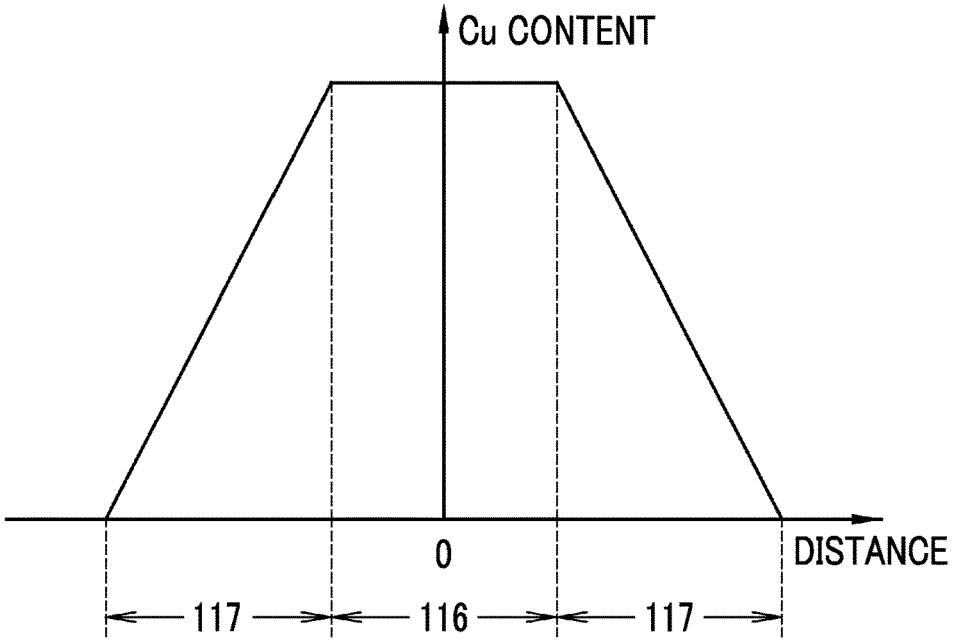
FIG. 39 is a graph illustrating copper (Cu) content.
Figure 40:
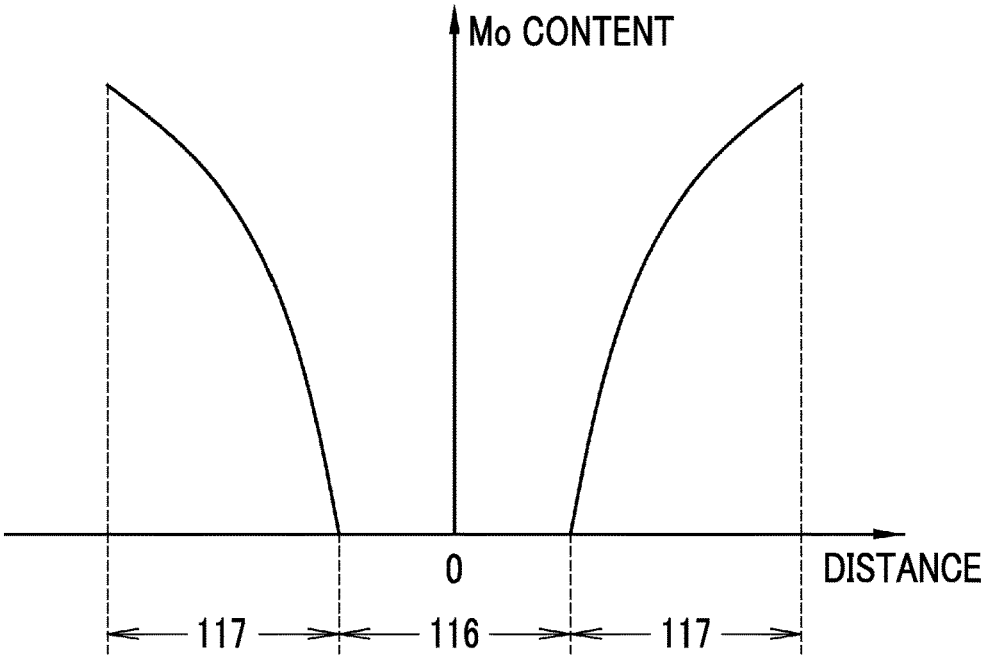
FIG. 40 is a graph illustrating molybdenum (Mo) content.
Figure 41:
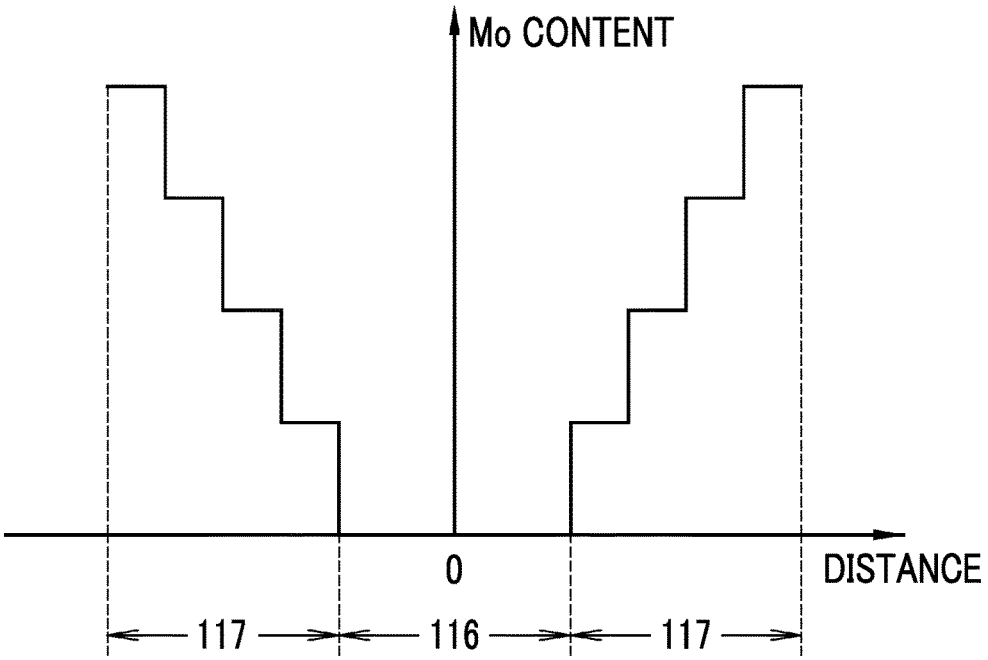
FIG. 41 is a graph illustrating molybdenum (Mo) content.

The content of an X-ray shielding material in the second member 117 may increase according to the distance from the first member 116. That is, the second member 117 may be configured such that molybdenum content becomes higher as the second member 117 becomes further away from the first member 116. For example, in a case in which the first member 116 is made of copper (Cu) and the second member 117 is made of an alloy of copper (Cu) and molybdenum (Mo) which is an X-ray shielding material, the second member 117 may be configured such that molybdenum content (Mo content) increases linearly according to the distance from the first member 116, as illustrated in FIG. 38. In this case, as illustrated in FIG. 39, the copper content (Cu content) of the second member 117 decreases linearly according to the distance from the first member 116. In addition, for example, as illustrated in FIG. 40, the second member 117 may be configured such that Mo content increases according to the distance from the first member 116 and on the basis of any curve. As illustrated in FIG. 41, the second member 117 may be configured such that Mo content increases stepwise according to the distance from the first member 116.

Figure 42:
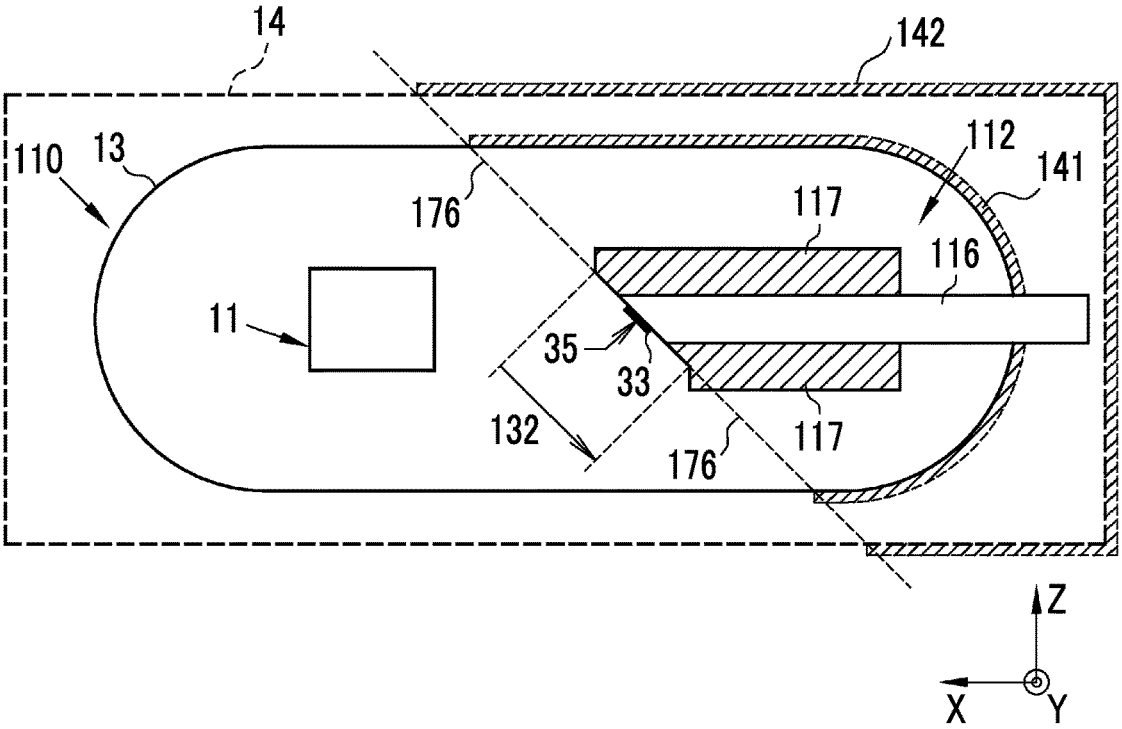
FIG. 42 is a diagram illustrating the operation of an anode including a first member and a second member.

As described above, since the anode 112 includes the first member 116 and the second member 117, the anode 112 including the X-ray generation point 35 can shield unnecessary X-rays in the X-ray tube 110. Specifically, X-rays are generated from the X-ray generation point 35 in all directions. As illustrated in FIG. 42, unnecessary X-rays which are generated toward the rear of the anode surface 132, that is, a range including the anode 112 on the basis of a plane 176 extending from the anode surface 132 are shielded by the first member 116 or the second member 117 of the anode 112. The anode 112 can shield unnecessary X-rays which are generated toward the rear of the anode surface 132 with a smaller amount of X-ray shielding material than an X-ray shielding member 141 provided on the envelope 13 or an X-ray shielding member 142 provided on the housing 14 in order to shield unnecessary X-rays generated toward the rear of the anode surface 132. As a result, it is possible to reduce the weight of the X-ray tube 110.

In addition, since the specific gravity of the second member 117 is greater than that of the first member 116, the X-ray tube 110 with light weight can effectively shield unnecessary X-rays generated toward the rear of the anode surface 132. Since the first member 116 has a higher thermal conductivity than the second member 117, the X-ray tube 110 can effectively exhaust and dissipate heat generated together with X-rays.

In a case in which the first member 116 is made of copper or an alloy including copper and molybdenum and the second member 117 is made of an alloy including copper and molybdenum, the X-ray tube 110 easily exhausts and dissipates heat generated together with X-rays and shields unnecessary X-rays. Since the content of the X-ray shielding material in the second member 117 is higher than that in the first member 116, the X-ray tube 110 can easily exhaust and dissipate heat generated together with X-rays and shield unnecessary X-rays.

For example, the anode 112 in which the first content portion 133 and the second content portion 134 are provided in the second member 117 is configured such that the content of the X-ray shielding material increases toward the outer side of the anode 112 and the X-ray shielding performance increases as the distance from the central axis 131 to the outer side of the anode 112 increases. With this configuration, the X-ray tube 110 can effectively shield unnecessary X-rays particularly with a small amount of X-ray shielding material. In addition, the X-ray tube 110 can exhaust or dissipate heat and shield X-rays.

In particular, in the configuration in which the second member 117 includes the first content portion 133 and the second content portion 134 (see FIG. 36), it is possible to achieve both a reduction (reduction in weight) of the amount of X-ray shielding material used and an X-ray shielding effect (unnecessary X-ray shielding rate) with a simple structure in a well-balanced manner. For example, the weight of the X-ray tube 110 is less than that in a case in which the content of the X-ray shielding material in the entire second member 117 is constant and the X-ray shielding performance can be maintained at a level equal to or higher than that in the case.

In a case in which the second member 117 includes two portions, that is, the first content portion 133 and the second content portion 134 (see FIG. 37), it is easy to manufacture the second member 117 in addition to achieving the good balance between a reduction (reduction in weight) in the amount of X-ray shielding material used and an X-ray shielding effect (unnecessary X-ray shielding rate). This is because the second member 117 is formed by only two portions, that is, the first content portion 133 and the second content portion 134.

In the configuration in which the content of the X-ray shielding material in the second member 117 becomes higher as the second member 117 becomes further away from the first member 116 (for example, see FIG. 39), it is possible to optimize a reduction (reduction in weight) in the amount of X-ray shielding material used and an X-ray shielding effect (unnecessary X-ray shielding rate).

Since the anode 112 is provided with the thick portion 122 and the thin portion 123 in the envelope 13, the X-ray shielding performance can be improved by the thick portion 122 and the heat dissipation performance can be improved by the thin portion 123. Therefore, the configuration in which the anode 112 includes the thick portion 122 and the thin portion 123 makes it possible to achieve both heat dissipation and the shielding of X-rays.

Eighth Embodiment

It is preferable that the X-ray tube 110 according to the seventh embodiment comprises a tube wall shielding member that is provided on a portion of the envelope 13 which X-rays (unnecessary X-rays) reach and shields X-ray. The reason is to shield unnecessary X-rays which are not capable of being shielded by the anode 112 with the inner surface or the outer surface of the envelope 13. In a case in which the tube wall shielding member is provided, the weight of the X-ray tube 10 can be less than that in a case in which the X-ray shielding member is provided on the housing 14 for the same purpose.

Figure 43:
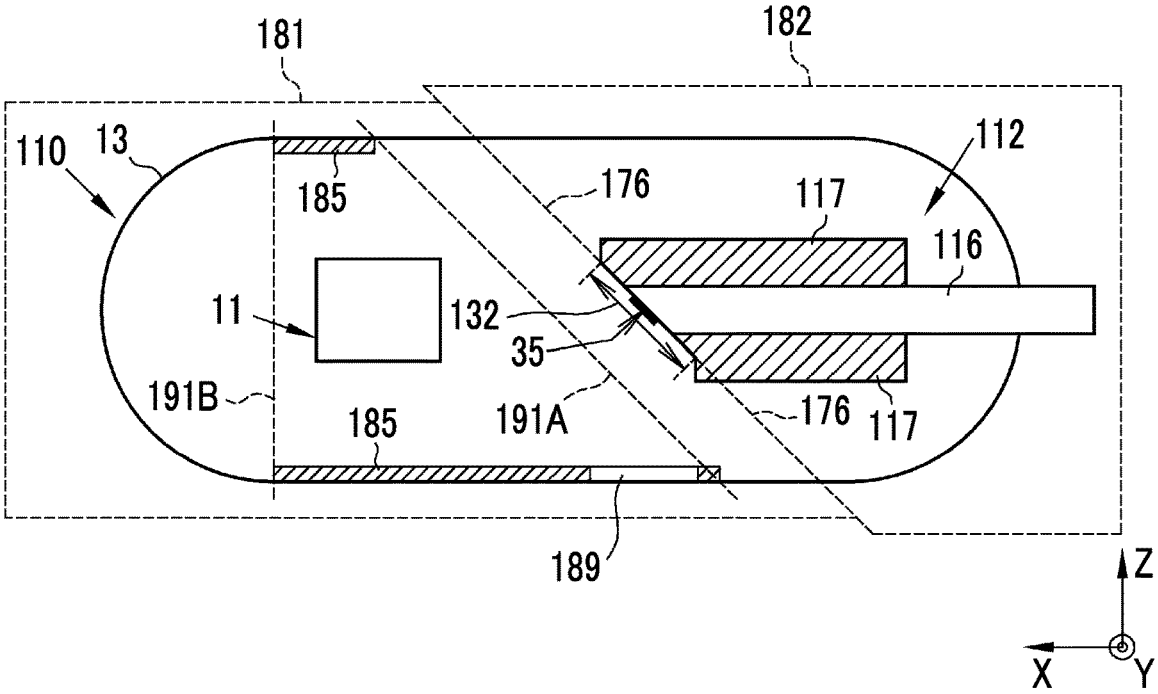
FIG. 43 is a cross-sectional view illustrating an X-ray tube provided with a tube wall shielding member.

Specifically, as illustrated in FIG. 43, the anode surface 132 including the X-ray generation point 35 in the surface of the anode 112 is planar. The "planar" anode surface 132 means a substantially and locally flat surface. In a case in which a surface including the X-ray generation point 35 in the surface of the anode has an uneven portion, but is flat in the vicinity of at least the X-ray generation point 35 (for example, at least a portion in which the target 35 is disposed), the flat surface (planar portion) is the anode surface 132. In addition, the anode surface 132 is a tangent plane to the X-ray generation point 35 in a case in which the surface including the X-ray generation point 35 in the anode surface is not flat in the vicinity of the X-ray generation point 35, for example, since the surface has a negligible curvature in relation to the sizes of other members. In addition, in a case in which there is an uneven portion at the X-ray generation point 35 or in the vicinity of the X-ray generation point 35, the surface of the X-ray generation point 35 or a surface in vicinity of the X-ray generation point 35 is naturally smoothed and the tangent plane is determined. In any case, the anode surface 132 roughly divides the X-ray tube 110 into a range (portion) in which X-rays transmitted through the anode 112 reach in a case in which the entire anode 112 transmits X-rays and a range (portion) in which X-rays reached without being transmitted through the anode 112.

The X-ray tube 110 (envelope 13) is divided into a cathode-side portion 181 including the cathode assembly 11 and an anode-side portion 182 including the anode 112 by the plane 176 including the anode surface 132 as a boundary. In this case, a tube wall shielding member 185 is provided on at least a portion of the surface of the envelope 13 in the cathode-side portion 181. In addition, in the tube wall shielding member 185, for example, an opening 189 (X-ray transmission window) or a cutout is formed in a portion included in the usage direction 36. The reason is to transmit X-rays.

In this embodiment, it is assumed that the boundary between a portion including the tube wall shielding member 185 and a portion that does not include the tube wall shielding member 185 is a plane. In this case, of boundary planes 191A and 191B between the portion including the tube wall shielding member 185 and the portions that do not include the tube wall shielding member 185, the boundary plane 191A that is closest to the plane 176 including the anode surface 132 is parallel to the anode surface 132. As such, in a case in which the boundary plane 191A that is closest to the plane 176 including the anode surface 132 is parallel to the anode surface 132, it is possible to effectively shield unnecessary X-rays that are not capable of being shielded by the anode 112 while reducing the amount (weight, volume, and area) of tube wall shielding member 185.

Figure 44:
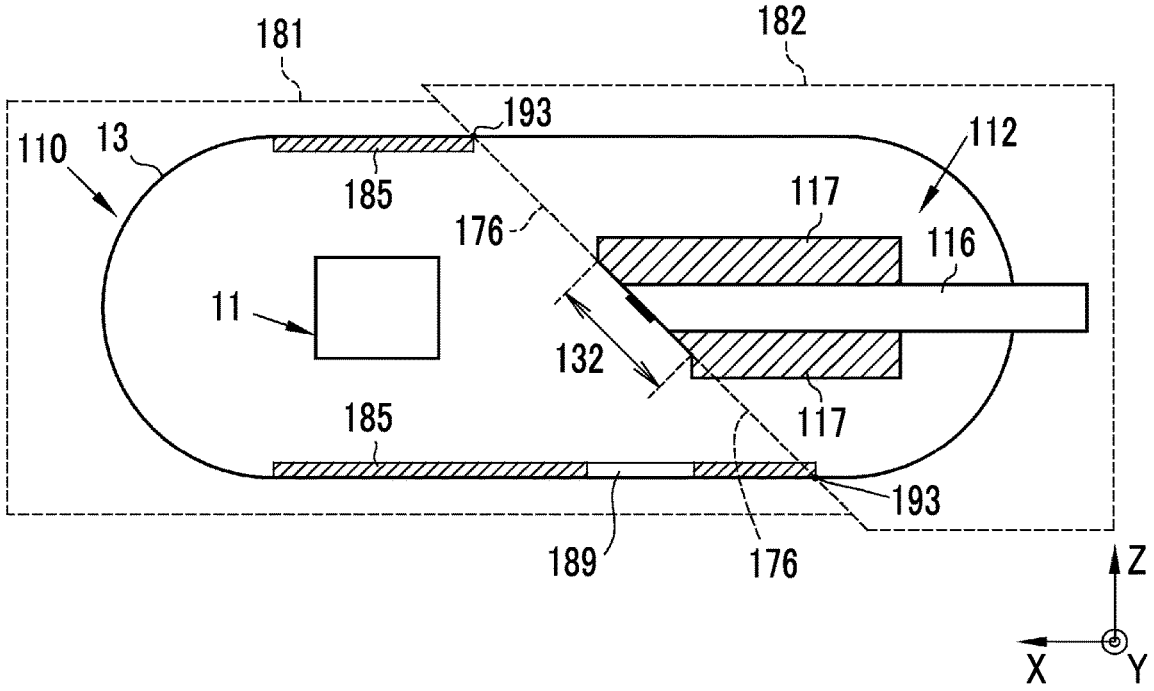
FIG. 44 is a diagram illustrating the disposition of the tube wall shielding member.

In addition, as illustrated in FIG. 44, of the boundary planes 191A and 191B between the portion including the tube wall shielding member 185 and the portions that do not include the tube wall shielding member 185, the boundary plane 191A that is closest to the plane 176 including the anode surface 132 may be on an intersection line 193 between the envelope 13 and the plane 176 including the anode surface 132. That is, the tube wall shielding member 185 is at least provided so as to be closer to the cathode assembly 11 than the plane 176 extending from the anode surface 132 and an end of the tube wall shielding member 185 is on the intersection line 193 between the envelope 13 and the plane 176 extending from the anode surface 132. In this case, the anode 112 shields unnecessary X-rays generated toward the anode-side portion 182 and the tube wall shielding member 185 shields unnecessary X-rays generated toward the cathode-side portion 181. Therefore, unnecessary X-rays can be almost completely shielded by the anode 112 and the tube wall shielding member 185 in the envelope 13.

Figure 45:
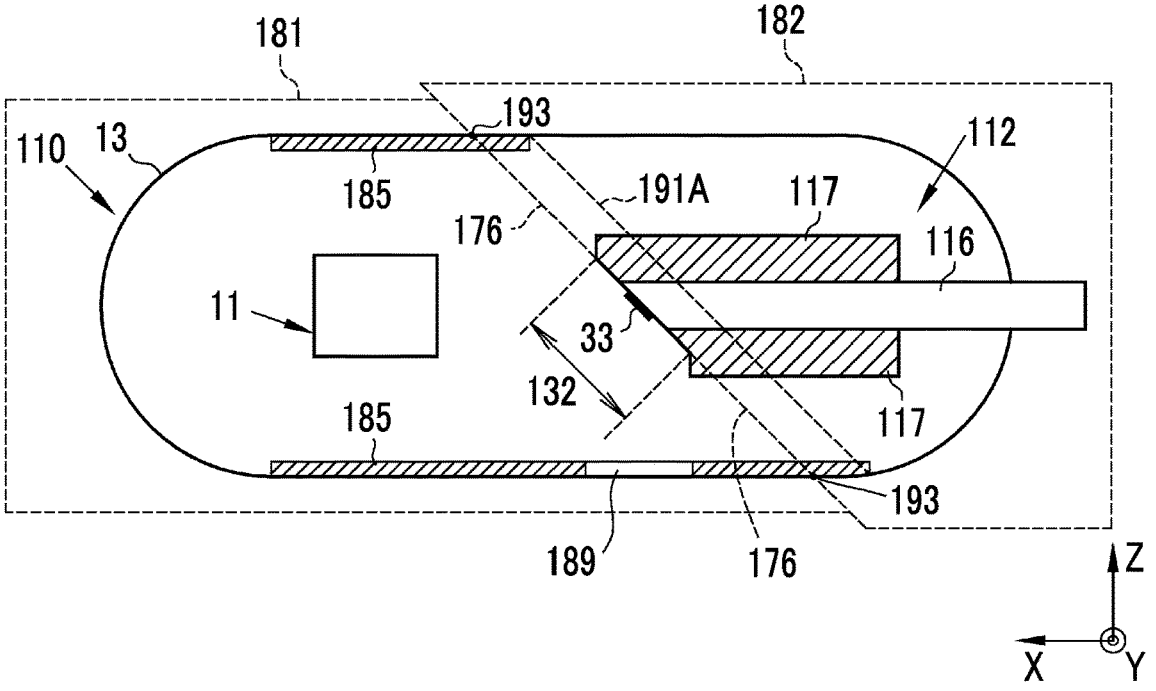
FIG. 45 is a diagram illustrating the disposition of the tube wall shielding member.

As illustrated in FIG. 45, of the boundary plane 191A and the boundary plane 191B, the boundary plane 191A that is closest to the plane 176 including the anode surface 132 may be in the anode-side portion 182. In this case, a range in which the tube wall shielding member 185 shields unnecessary X-rays and a range in which the anode 112 shields unnecessary X-rays partially overlap each other. Therefore, it is possible to more reliably shield unnecessary X-rays.

It is preferable that the shape of a boundary line (the cross-sectional shape of the tube wall shielding member 185 by the boundary plane 191A) in the boundary plane 191A that is closest to the plane 176 including the anode surface 132 is a circle or an ellipse. In this case, it is possible to reduce the size of the tube wall shielding member 185 while reliably shielding unnecessary X-rays.

Ninth Embodiment

It is preferable that the X-ray tubes 110 according to the seventh and eighth embodiments further comprises an additional shielding member which shields unnecessary X-rays between the second member 117 and the envelope 13. The additional shielding member is an X-ray shielding member including, for example, lead, tungsten, and molybdenum.

Figure 46:
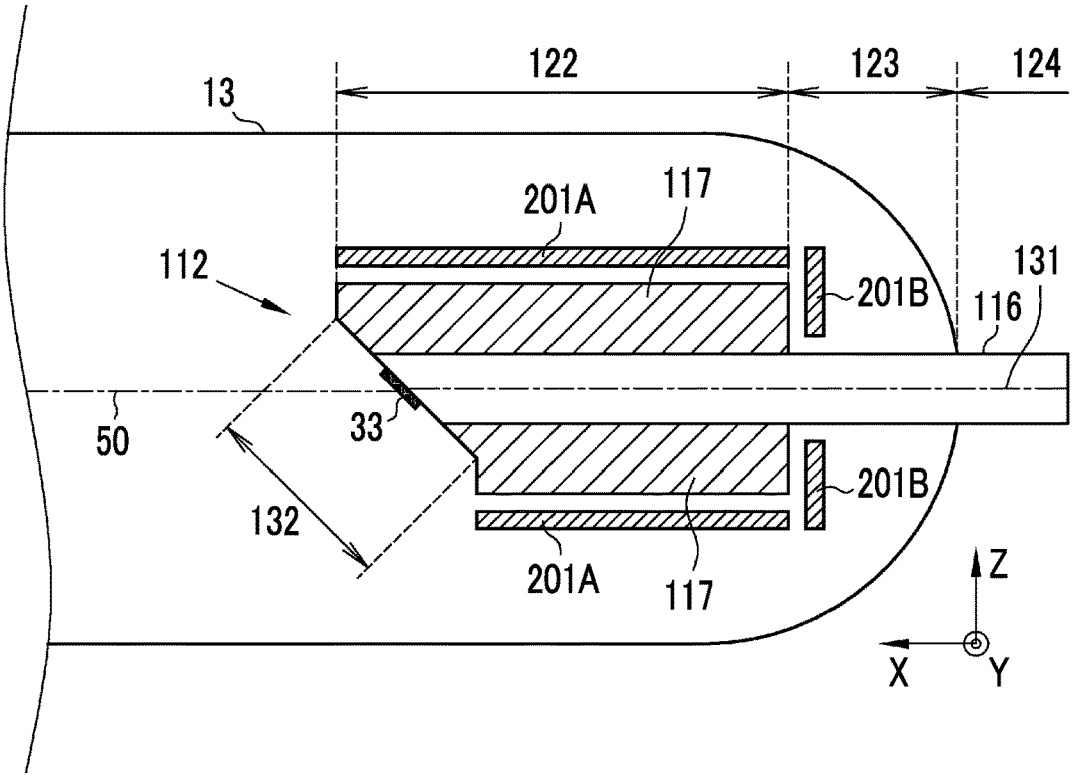
FIG. 46 is a cross-sectional view illustrating an X-ray tube provided with additional shielding members.

Specifically, as illustrated in FIG. 46, an additional shielding member 201A is provided between the second member 117 and the envelope 13 in a direction (a direction in the YZ plane) perpendicular to the central axis 131 of the first member 116 (anode 112). In addition, in this embodiment, an additional shielding member 201B is provided between the second member 117 and the envelope 13 in a direction which is parallel to the first member 116 and in which the first member 116 extends to the outside of the envelope 13 (in the thin portion 123). That is, the additional shielding member 201A and the additional shielding member 201B surround the thick portion 122 except a portion in which the anode surface 132 is present. As such, in a case in which the additional shielding member 201A and/or the additional shielding member 201B is provided, unnecessary X-rays can be more reliably shielded by the anode 112, the additional shielding member 201A, and/or the additional shielding member 201B than that in a case in which unnecessary X-rays are shielded by only the anode 112.

Figure 47:
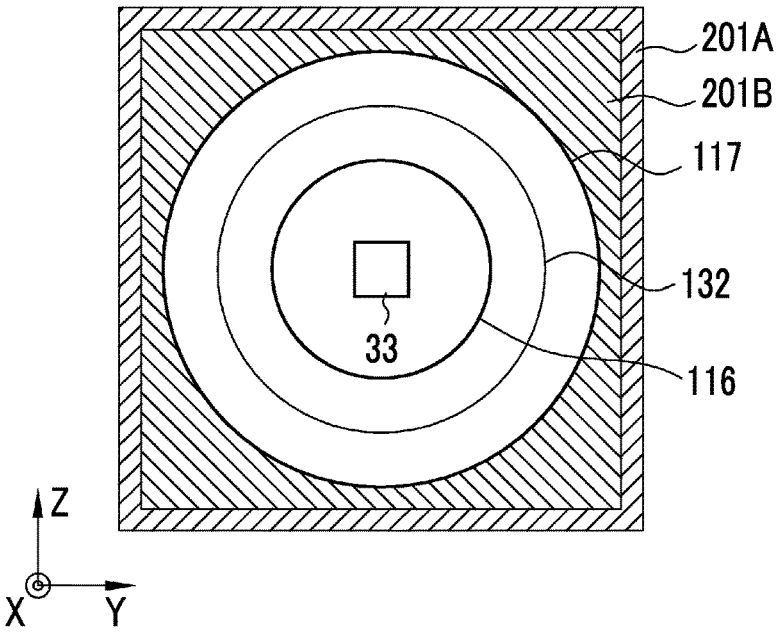
FIG. 47 is a diagram illustrating the shape of the additional shielding members.

As illustrated in FIG. 47, both the additional shielding member 201A and the additional shielding member 201B form, for example, a hollow quadrangular prism shape that has the additional shielding member 201B as the bottom and is obliquely cut with respect to the central axis 131. As such, in a case in which the additional shielding member 201A and the additional shielding member 201B form a prism shape that is obliquely cut, it is easy to manufacture the additional shielding member 201A and the additional shielding member 201B. Therefore, a material that is difficult to process due to, for example, hardness, but has a high X-ray shielding performance is easily used for the additional shielding member 201A and the additional shielding member 201B.

Figure 48:
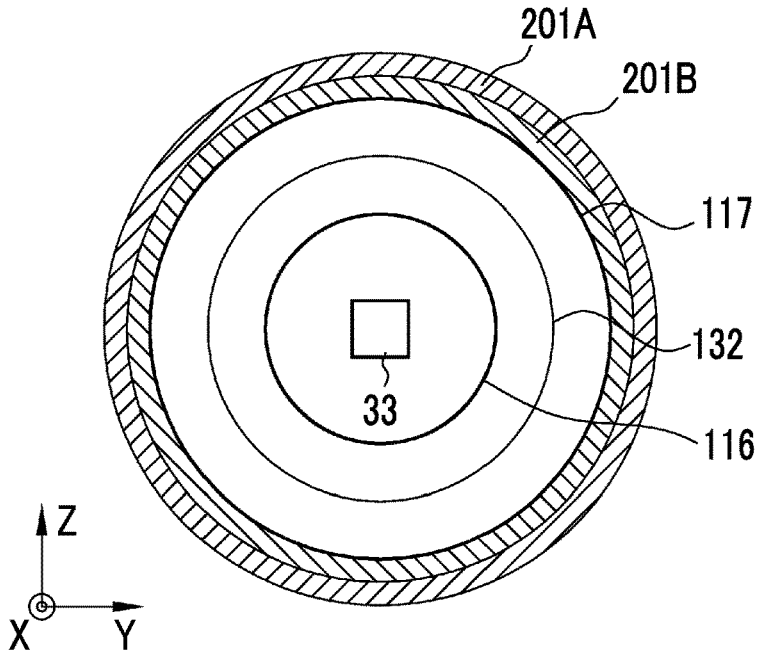
FIG. 48 is a diagram illustrating the shape of the additional shielding members.

In addition, as illustrated in FIG. 48, both the additional shielding member 201A and the additional shielding member 201B may form, for example, a hollow cylindrical shape which has the additional shielding member 201B as the bottom and in which the cathode assembly 11 is obliquely cut with respect to the central axis 131. In a case in which the anode 112 has a substantially cylindrical shape and the additional shielding member 201A and the additional shielding member 201B form a cylindrical shape that is obliquely cut, it is possible to minimize the amount (weight, volume, and area) of additional shielding members 201A and 201B. Therefore, it is possible to provide the lightest-weight additional shielding members 201A and 201B. In addition, the additional shielding members may have any shape.

Figure 49:
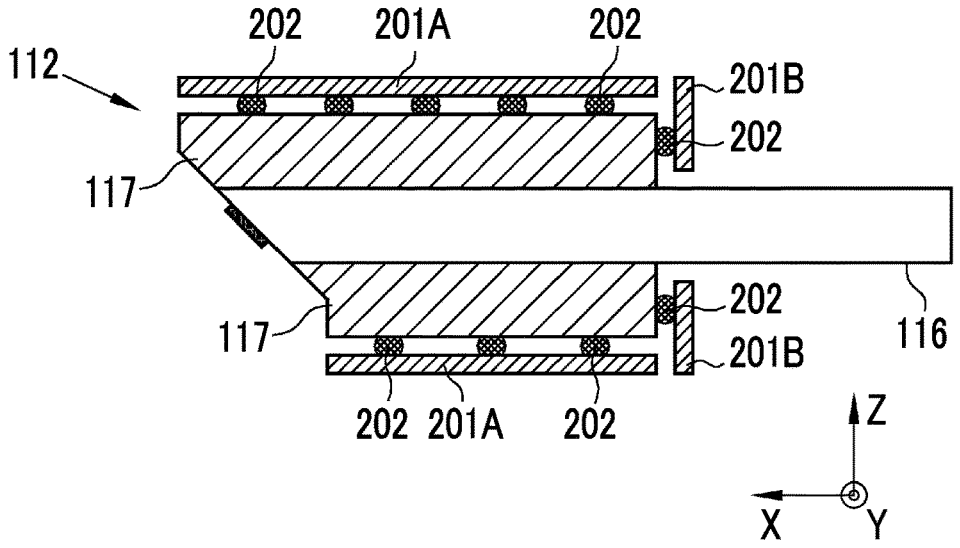
FIG. 49 is a diagram illustrating bonding spots of the additional shielding members.

The additional shielding member 201A and the additional shielding member 201B may be bonded to the second member 117. In this case, it is preferable that the additional shielding member 201A and the additional shielding member 201B are partially bonded to the second member 117. For example, as illustrated in FIG. 49, the additional shielding member 201A and the additional shielding member 201B are bonded at one bonding spot 202 or a plurality of bonding spots 202 which are a portion of the additional shielding member 201A and the additional shielding member 201B by welding, adhesion, fitting, screwing, or other methods. As such, in a case in which the additional shielding members, such as the additional shielding member 201A and the additional shielding member 201B, are provided and partially bonded to the second member 117, the additional shielding members can be supported by the anode 112 (second member 117). As a result, it is unnecessary to provide other support portions for fixing the anode 112 to the envelope 13. In addition, in a case in which the additional shielding members are partially bonded to the second member 117, it is easy to perform bonding. Therefore, in a case in which the additional shielding members are provided and partially bonded to the second member 117, manufacturability is improved.

Figure 50:
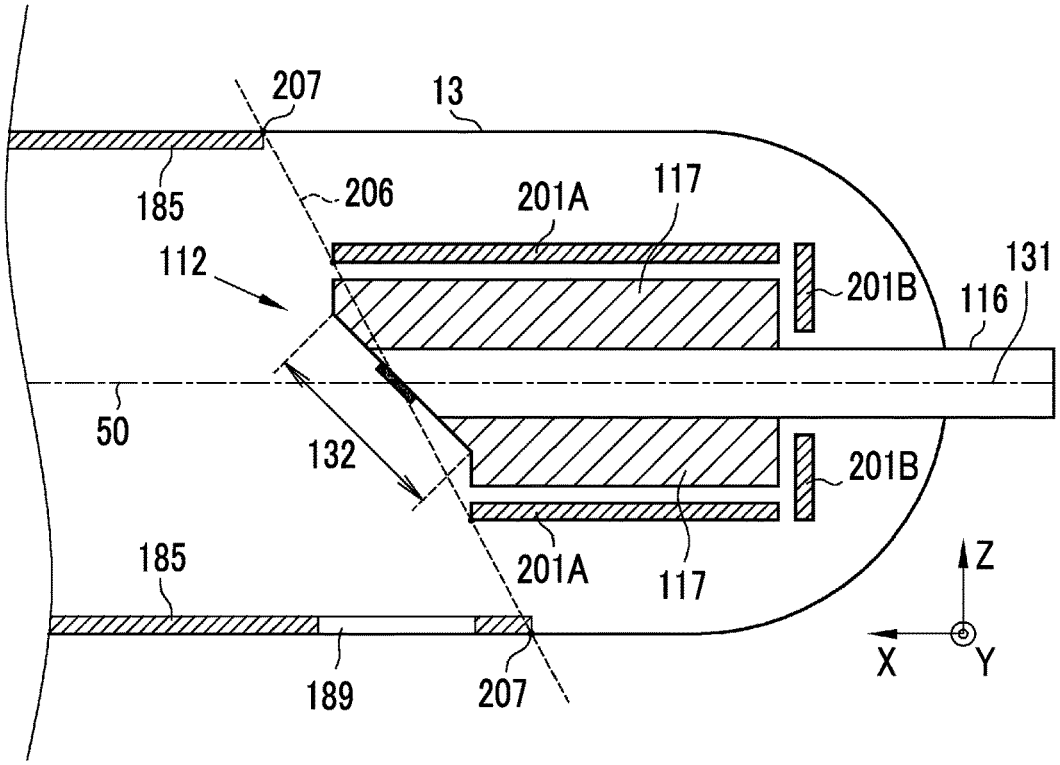
FIG. 50 is a diagram illustrating the disposition of the tube wall shielding member in a case in which the additional shielding members are provided.

As described above, in a case in which the X-ray tube 110 is provided with the additional shielding member 201A and/or the additional shielding member 201B, it is preferable to provide the tube wall shielding member 185 as illustrated in FIG. 50. However, the tube wall shielding member 185 preferably shields unnecessary X-rays in at least a portion in which the additional shielding member 201A and/or the additional shielding member 201B does not shield unnecessary X-rays. Therefore, for example, in a case in which an opening of the additional shielding member 201A which is close to the cathode assembly 11 is in a plane 206, the tube wall shielding member 185 may extend up to an intersection line 207 between the plane 206 and the envelope 13.

Figure 51:
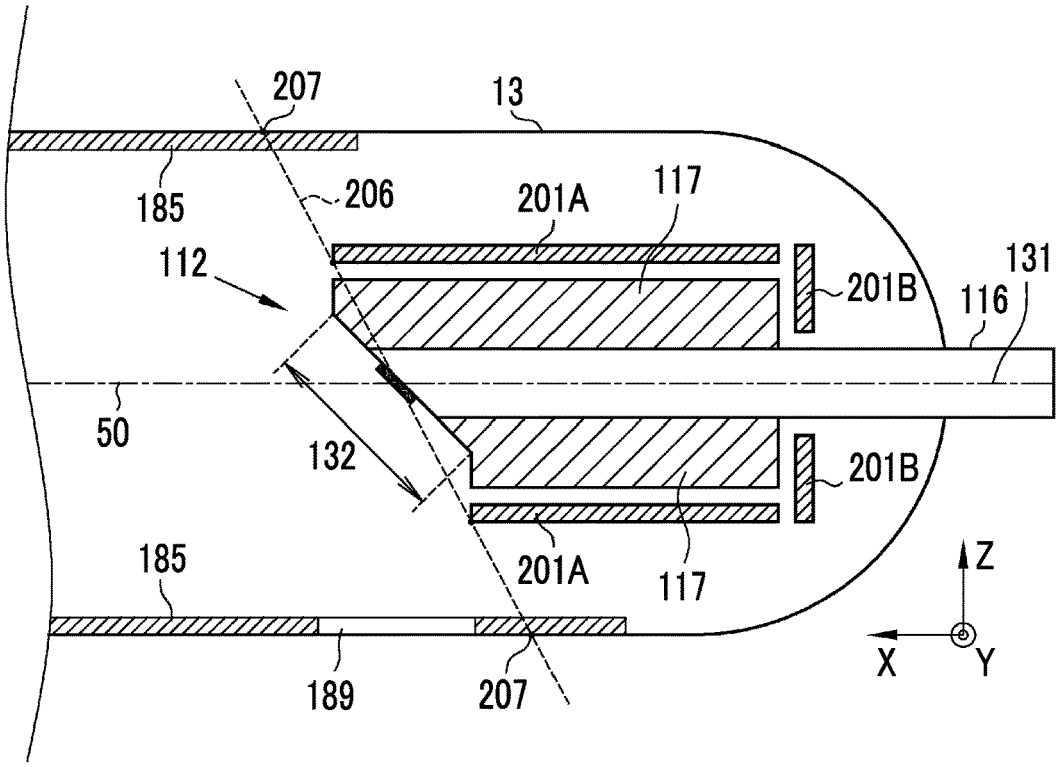
FIG. 51 is a diagram illustrating the disposition of the tube wall shielding member in a case in which the additional shielding members are provided.
Figure 52:
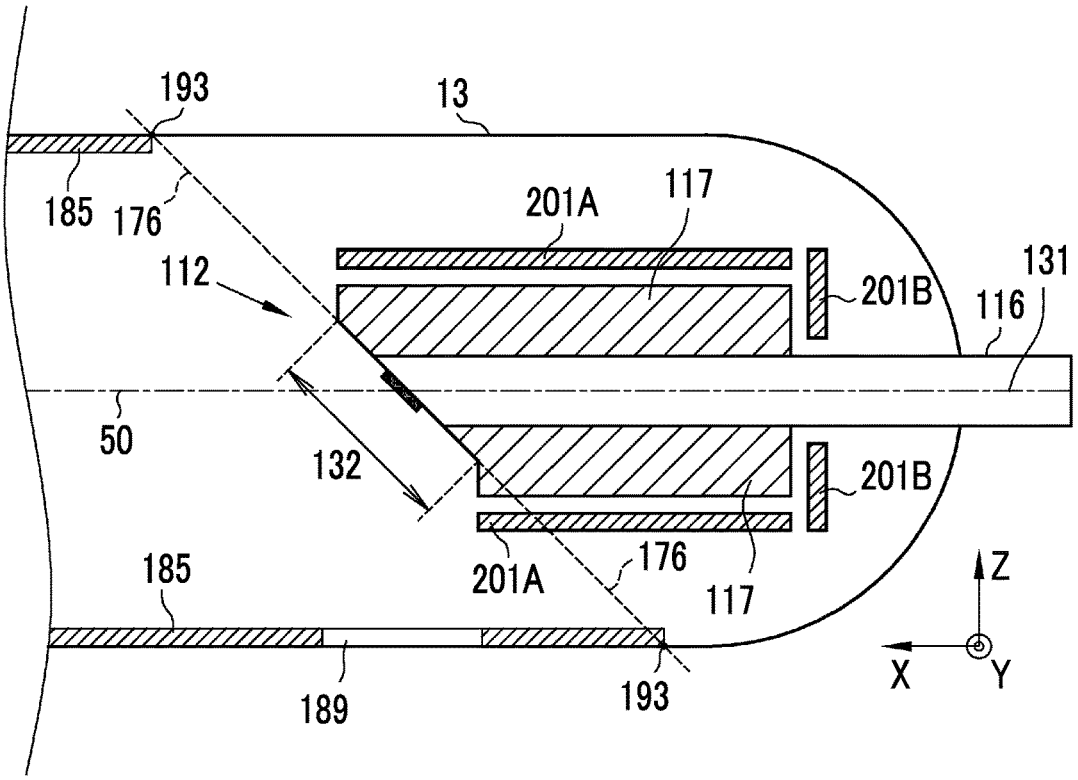
FIG. 52 is a diagram illustrating the disposition of the tube wall shielding member in a case in which the additional shielding members are provided.
Figure 53:
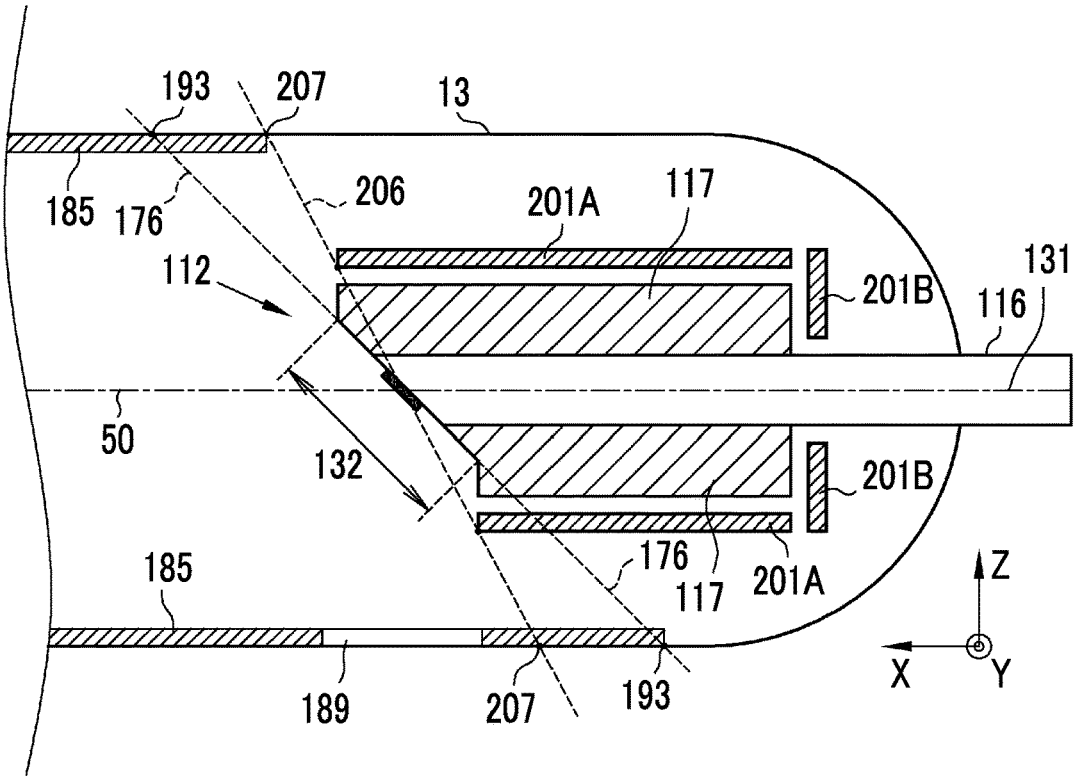
FIG. 53 is a diagram illustrating the disposition of the tube wall shielding member in a case in which the additional shielding members are provided.

Furthermore, as illustrated in FIG. 51, the tube wall shielding member 185 may protrude from the plane 206 to the anode 112. In this case, it is possible to more reliably shield unnecessary X-rays. In addition, as illustrated in FIG. 52, even in a case in which the additional shielding member 201A and/or the additional shielding member 201B is provided, the tube wall shielding member 185 may extend up to the intersection line 193 between the plane 176 including the anode surface 132 and the envelope 13. In this case, it is also possible to shield unnecessary X-rays. The reason is that the anode 112 has an X-ray shielding function. In addition, as illustrated in FIG. 53, in a case in which the additional shielding member 201A and/or the additional shielding member 201B and the tube wall shielding member 185 are provided, a portion of the tube wall shielding member 185 may be provided up to the position of the intersection line 207 between the plane 206 and the envelope 13 and another portion of the tube wall shielding member 185 may be provided up to the position of the intersection line 193 between the plane 176 including the anode surface 132 and the envelope 13.

Figure 54:
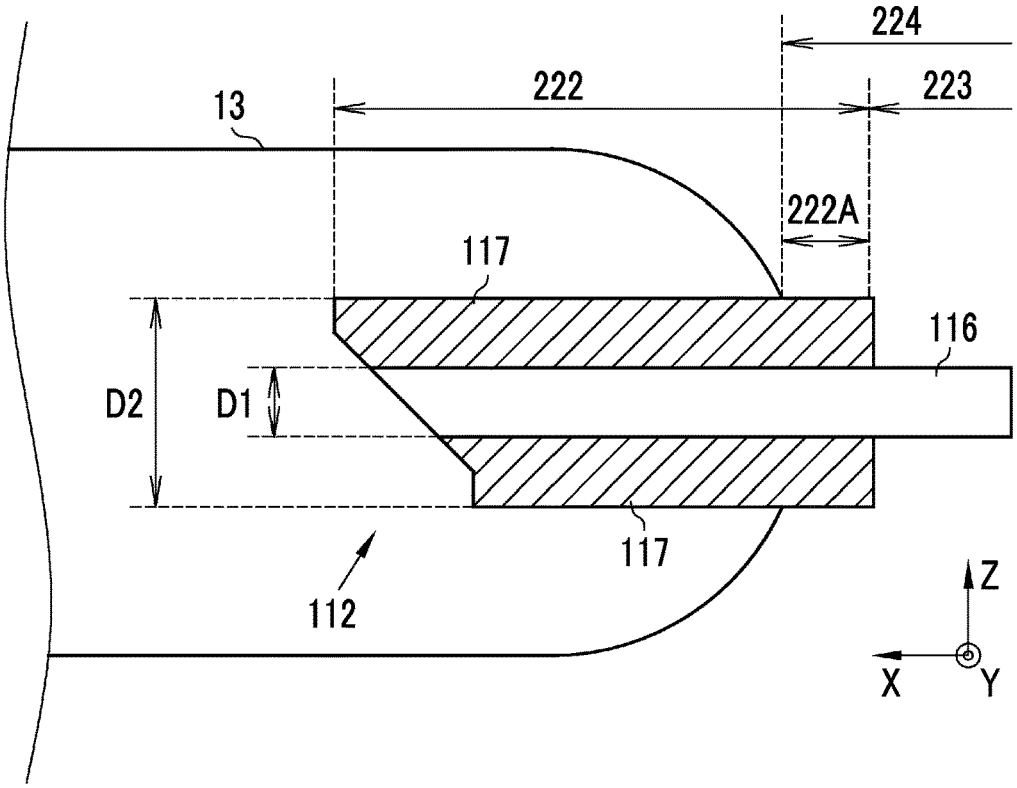
FIG. 54 is a cross-sectional view illustrating a modification example in which a second member extends to the outside of the envelope.

In the seventh, eighth, and ninth embodiments, the anode 112 is configured such that only the first member 116 extends to the outside of the envelope 13 (extension portion 124) and the entire second member 117 is in the envelope 13. However, for example, as illustrated in FIG. 54, the anode 112 may be configured such that a portion of the second member 117 extends to the outside of the envelope 13. In this case, the anode 112 has a thick portion 222 and a thin portion 223. The thick portion 222 is a portion that is formed by the first member 116 and the second member 117 and extends from the inside to the outside of the envelope 13. The thin portion 223 is a portion (without the second member 117) that is formed by the first member 116. The entire thin portion 223 is outside the envelope 13. In addition, a part 222A of the thick portion 222 which extends to the outside of the envelope 13 and the thin portion 223 form an extension portion 224, which extends to the outside of the envelope 13, in the anode 112.

As such, in a case in which a portion of the second member 117 extends to the outside of the envelope 13, the anode 112 can be connected to the envelope 13 in the thick portion 222, which makes it easy to manufacture the X-ray tube. In addition, in a case in which a portion of the second member 117 extends to the outside of the envelope 13 and the thick portion 222 is exposed outside the envelope 13, the surface area of the anode 112 that comes into contact with the outside air increases. Therefore, the efficiency of heat exhaust or heat dissipation is improved.

Any amount (a length along the first member 116 or the central axis 131) of second member 117 extends to the outside of the envelope 13. Therefore, even in a case in which the amount of second member 117 extending to the outside of the envelope 13 is "zero", the above-mentioned effect is obtained. That is, in a case the second member 117 is exposed to the outside of the envelope 13 from at least the surface of the envelope 13, the above-mentioned effect is obtained. Therefore, a state in which "the second member 117 extends to the outside of the envelope 13" includes a state in which the second member 117 is exposed to the outside of the envelope 13 from the surface of the envelope 13.

Figure 55:
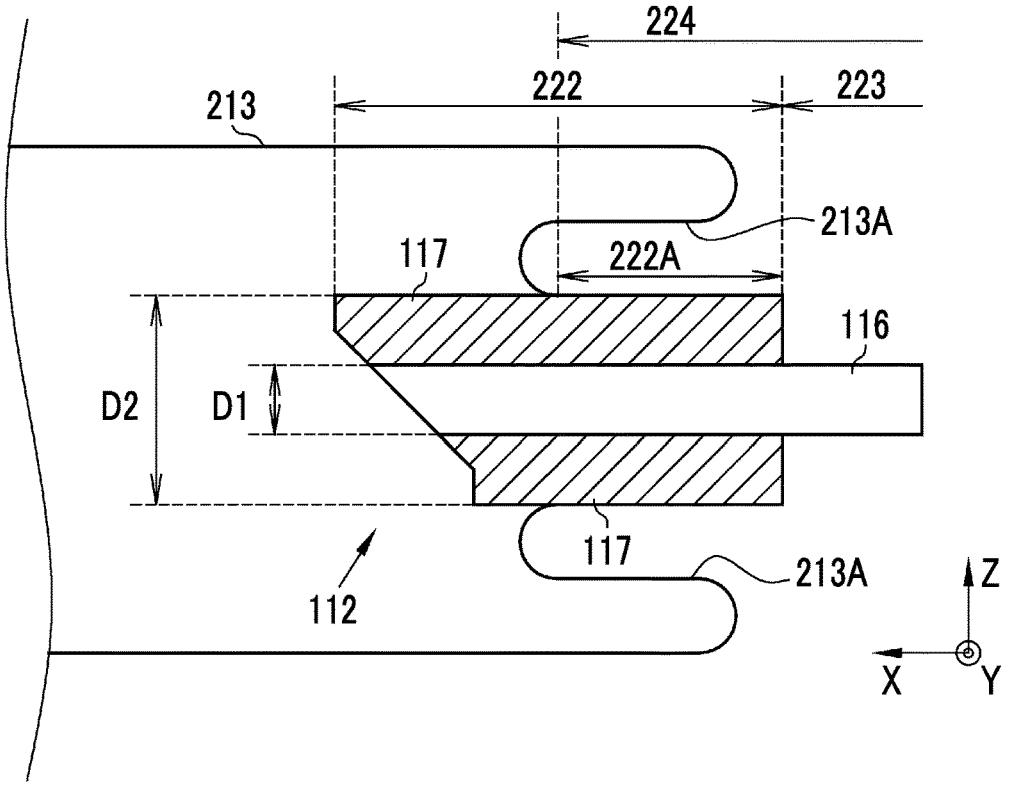
FIG. 55 is a cross-sectional view illustrating a modification example in which a second member extends to the outside of the envelope.

For example, in some cases, as illustrated in FIG. 55, an envelope 213 is deformed such that a concave portion 213A is formed in a connection portion with the anode 112. In the anode 112, a portion of the second member 117 extends to the envelope 13 according to, for example, the depth of the concave portion 213A. In this case, similarly to the above, the anode 112 has a thick portion 222 and a thin portion 223. In addition, a part 222A of the thick portion 222 which extends to the outside of the envelope 13 and the thin portion 223 form an extension portion 224, which extends to the outside of the envelope 13, in the anode 112. For example, an operation is the same as that in the above-mentioned examples.

In the X-ray tubes 10 according to the first to sixth embodiments and the modification examples of the first to sixth embodiments, the shielding portion 40 is used to shield unnecessary X-rays. In the X-ray tubes 110 according to the seventh to ninth embodiments and the modification examples of the seventh to ninth embodiments, the anode 112 is used to shield unnecessary X-rays. However, any combinations of these configurations can be made.

Figure 56:
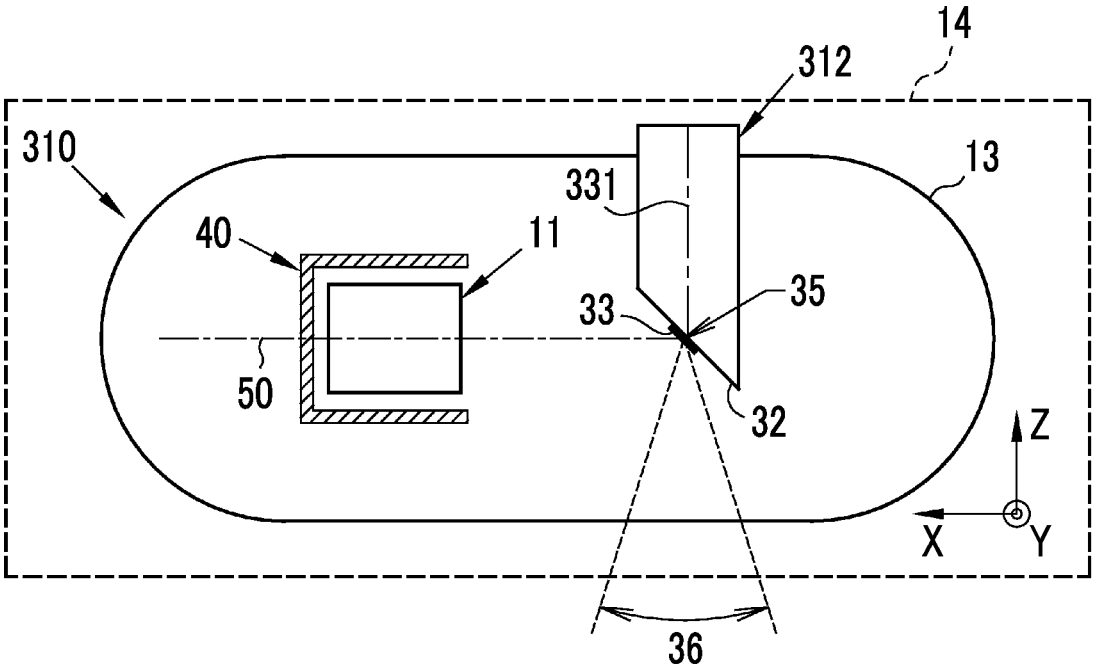
FIG. 56 is a cross-sectional view illustrating an X-ray tube in which a reference line is not parallel to a central axis of an anode.

In the X-ray tubes 10 according to the first to sixth embodiments and the modification examples of the first to sixth embodiments, the reference line 50 is parallel to the central axis 31 of the anode 12. In the X-ray tubes 110 according to the seventh to ninth embodiments and the modification examples of the seventh to ninth embodiments, the reference line 50 is parallel to the central axis 131 of the anode 112. However, the central axis 31 of the anode 12 (the central axis 131 in the case of the anode 112, which holds for the following description) may not be parallel. For example, as illustrated in FIG. 56, in an X-ray tube 310, the reference line 50 is perpendicular to a central axis 331 of an anode 312. As illustrated in FIG. 54, in the X-ray tube 310, it is preferable that the shielding portion 40 is provided as in the X-ray tubes 10 according to the first to sixth embodiments and the modification examples of the first to sixth embodiments. In addition, instead of the shielding portion 40 or in addition to the shielding portion 40, the same anode 112 as that in the X-ray tubes 110 according to the seventh to ninth embodiments and the modification examples of the seventh to ninth embodiments may be provided in the X-ray tube 310. This holds for the tube wall shielding member 185, the additional shielding member 201A, and the additional shielding member 201B.

EXPLANATION OF REFERENCES

10: X-ray tube
11: cathode
12, 112, 312: anode
13: envelope
14: housing
21: filament
22: first electrode
22*a*, 213A: concave portion
23: second electrode
31: central axis
32: anode surface (oblique surface)
33: target
35: X-ray generation point
36: usage direction
38: wire
39: support portion
40: shielding portion
41: first shielding portion
42: second shielding portion
50: reference line
51: center

52, 53: intersection point
56: reference plane
57, 58: intersection line
61, 62: shielding portion
66, 71: plane
67, 68: arrow
73: X-ray detection panel
73A: imaging surface
76, 82, 176, 206: plane
78: X-ray shielding member
81: dashed line
91: tube wall shielding member
92, 189: opening
93: portion
96: bonding portion
110: X-ray tube
116: first member
117: second member
122: thick portion
123: thin portion
124: extension portion
131: central axis
132: anode surface
133: first content portion
134: second content portion
141, 142: X-ray shielding member
181: cathode-side portion
182: anode-side portion
185: tube wall shielding member
191A, 191B: boundary plane
193, 207: intersection line
201A, 201B: additional shielding member
202: bonding spot
310: X-ray tube
331: central axis
Ac: direction
Cu: copper
d1, d2: distance
E1: opening end
E2: connection portion
E3, E4, E5: edge
Mo: molybdenum

What is claimed is:

1. An X-ray tube comprising:
a cathode assembly that emits electrons;
an anode having a target that receives the electrons and generates X-rays;
an envelope that is a case having the cathode assembly and the anode accommodated therein;
a first shielding portion that shields the X-rays between the envelope and the cathode assembly on a reference line that connects a center of a point where the electrons are generated and a center of a point where the X-rays are generated; and
a second shielding portion that shields the X-rays between the envelope and the cathode assembly in a direction perpendicular to the reference line from the center of the electron generation point,
wherein the distance between the second shielding portion and the reference line is larger on an anode side than an opposite side.

2. The X-ray tube according to claim 1,
wherein the first shielding portion is longer than the cathode assembly in the direction perpendicular to the reference line.

3. The X-ray tube according to claim 1,
wherein the second shielding portion is longer than the cathode assembly in a direction parallel to the reference line.

4. The X-ray tube according to claim 1,
wherein the second shielding portion protrudes from the cathode assembly to the anode.

5. The X-ray tube according to claim 1,
wherein some or all of angles formed between the first shielding portion and the second shielding portion are 90 degrees.

6. The X-ray tube according to claim 1,
wherein some or all of angles formed between the first shielding portion and the second shielding portion are greater than 90 degrees and are less than 180 degrees.

7. The X-ray tube according to claim 1,
wherein some or all of angles formed between the first shielding portion and the second shielding portion are less than 90 degrees.

8. The X-ray tube according to claim 1,
wherein angles formed between the first shielding portion and the second shielding portion include an angle of 90 degrees and an angle that is greater than 90 degrees and less than 180 degrees.

9. The X-ray tube according to claim 1,
wherein angles formed between the first shielding portion and the second shielding portion include an angle of 90 degrees and an angle of less than 90 degrees.

10. The X-ray tube according to claim 1,
wherein angles formed between the first shielding portion and the second shielding portion include an angle that is greater than 90 degrees and less than 180 degrees and an angle of less than 90 degrees.

11. The X-ray tube according to claim 1,
wherein angles formed between the first shielding portion and the second shielding portion include an angle of 90 degrees, an angle that is greater than 90 degrees and less than 180 degrees, and an angle of less than 90 degrees.

12. The X-ray tube according to claim 1, further comprising:
an electrode that is electrically connected to the first shielding portion or the second shielding portion.

13. The X-ray tube according to claim 1,
wherein the first shielding portion is bonded to the cathode assembly.

14. The X-ray tube according to claim 1,
wherein the second shielding portion is bonded to the cathode assembly.

15. The X-ray tube according to claim 1,
wherein at least some of edges of the first shielding portion and/or the second shielding portion are rounded.

16. The X-ray tube according to claim 1, further comprising:
a tube wall shielding member that is provided on a portion of the envelope which the X-rays reach and shields the X-rays.

17. The X-ray tube according to claim 16,
wherein the tube wall shielding member is provided in at least an intersection portion between the envelope and a plane extending from an anode surface which is a surface of the anode including the X-ray generation point.

18. The X-ray tube according to claim 1, wherein the second shielding portion is made of a material having easier workability than a material forming the first shielding portion.

* * * * *